US011603840B2

(12) United States Patent
Lee et al.

(10) Patent No.: US 11,603,840 B2
(45) Date of Patent: Mar. 14, 2023

(54) SCROLL COMPRESSOR HAVING COMPRESSION CHAMBER OIL SUPPLIES HAVING STAGES IN WHICH OIL SUPPLY OVERLAPS AND STAGES IN WHICH OIL SUPPLY DOES NOT OVERLAP

(71) Applicant: LG Electronics Inc., Seoul (KR)

(72) Inventors: Kyungho Lee, Seoul (KR); Jungsun Choi, Seoul (KR); Kangwook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/350,516

(22) Filed: Jun. 17, 2021

(65) Prior Publication Data

US 2022/0056910 A1 Feb. 24, 2022

(30) Foreign Application Priority Data

Aug. 20, 2020 (KR) ..... 10-2020-0104856

(51) Int. Cl.
*F04C 18/02* (2006.01)
*F04C 29/02* (2006.01)
*F04C 23/00* (2006.01)

(52) U.S. Cl.
CPC ..... *F04C 18/0261* (2013.01); *F04C 18/0215* (2013.01); *F04C 23/008* (2013.01); (Continued)

(58) Field of Classification Search
CPC ..... F04C 18/0215–0292; F04C 2/025; F04C 15/0088–0092; F04C 29/02–026; F01C 1/0215–0292; F01C 21/04–045
See application file for complete search history.

(56) References Cited

U.S. PATENT DOCUMENTS 5,212,964 A * 5/1993 Utter ..... F04C 18/023 418/55.6
5,449,279 A * 9/1995 Hill ..... F04C 27/005 418/55.6

(Continued)

FOREIGN PATENT DOCUMENTS

JP 06193570 A * 7/1994
JP 2010276001 12/2010

(Continued)

OTHER PUBLICATIONS

Office Action in Korean Appln. No. 10-2020-0104856, dated Sep. 28, 2021, 10 pages (with English translation).

(Continued)

*Primary Examiner* — Laert Dounis
(74) *Attorney, Agent, or Firm* — Fish & Richardson P.C.

(57) ABSTRACT

A scroll compressor according to the present disclosure includes a fixed scroll, an orbiting scroll forming first and compression chambers with the fixed scroll, first and second compression chamber oil supply holes formed through the orbiting scroll to communicate with the first compression chamber and the second compression chamber, respectively, wherein when a section in which the first compression chamber oil supply hole is opened toward the first compression chamber is a first oil supply section and a section in which the second compression chamber oil supply hole is opened toward the second compression chamber, a non-overlap section between the first oil supply section and the second oil supply section may be longer than an overlap section between the first oil supply section and the second oil supply section, so as to prevent communication between the first and second compression chambers, thereby suppressing leakage between the compression chambers.

19 Claims, 14 Drawing Sheets

(a)

(b)

(52) U.S. Cl.
CPC ..... *F04C 29/02* (2013.01); *F04C 29/023* (2013.01); *F04C 29/028* (2013.01); *F04C 2240/30* (2013.01); *F04C 2240/50* (2013.01); *F04C 2240/60* (2013.01)

(56) References Cited

U.S. PATENT DOCUMENTS

| | | | | |
|---|---|---|---|---|
| 2010/0129240 | A1 | 5/2010 | Shiibayashi et al. | |
| 2013/0216416 | A1* | 8/2013 | Takeda | F04C 18/0253 418/55.1 |
| 2014/0119971 | A1 | 5/2014 | Shiibayashi et al. | |
| 2014/0234148 | A1* | 8/2014 | Takeda | F04C 18/0269 418/55.2 |
| 2018/0172004 | A1 | 6/2018 | Lee et al. | |

FOREIGN PATENT DOCUMENTS

| | | | |
|---|---|---|---|
| JP | 2014163230 | | 9/2014 |
| KR | 20100017006 | A * | 2/2010 |
| KR | 20180138479 | | 12/2018 |
| KR | 20190131838 | | 11/2019 |

OTHER PUBLICATIONS

Extended European Search Report in European Appln. No. 21181336.5, dated Dec. 21, 2021, 7 pages.

* cited by examiner

SCROLL COMPRESSOR HAVING COMPRESSION CHAMBER OIL SUPPLIES HAVING STAGES IN WHICH OIL SUPPLY OVERLAPS AND STAGES IN WHICH OIL SUPPLY DOES NOT OVERLAP

CROSS-REFERENCE TO RELATED APPLICATION

Pursuant to 35 U.S.C. § 119(a), this application claims the benefit of the earlier filing date and the right of priority to Korean Patent Application No. 10-2020-0104856, filed on Aug. 20, 2020, the contents of which is incorporated by reference herein in its entirety.

TECHNICAL FIELD

This implementation relates to a scroll compressor, and more particularly, an oil supply structure of a scroll compressor.

BACKGROUND

A scroll compressor is a compressor forming a compression chamber including a suction chamber, an intermediate pressure chamber, and a discharge chamber between both scrolls while the plurality of scrolls is an engaged state. Such a scroll compressor may obtain a relatively high compression ratio and stable torque by smooth connection of suction, compression, and discharge strokes of refrigerant, as compared with other types of compressors. Therefore, the scroll compressors are widely used for compressing refrigerant in air conditioners or the like.

Scroll compressors may be classified into a top-compression type and a bottom-compression type according to a position of a compression unit relative to a motor unit. The top-compression type is a compressor in which the compression unit is disposed above the motor unit, and the bottom-compression type is a compressor in which the compression unit is disposed below the motor unit.

In the top-compression type, since the compression unit is located far from a lower space of a casing, oil stored in the lower space of the casing is difficult to be moved to the compression unit. On the other hand, in the bottom-compression type, since the compression unit is located close to the lower space of the casing, the oil stored in the lower space of the casing can be easily moved to the compression unit. An implementation according to the present disclosure will illustrate a bottom-compression type scroll compressor. Therefore, hereinafter, a scroll compressor may be defined as a bottom-compression type scroll compressor unless otherwise specified.

The scroll compressor is provided with an oil supply portion for guiding oil stored in the lower space of the casing to the compression unit. The oil supply portion may supply oil using an oil pump or using differential pressure. An oil supplying method using the differential pressure can eliminate a component such as an oil pump, thereby reducing a fabricating cost and effectively supplying oil to the compression unit.

Some scroll compressors include an oil supply structure using differential pressure. The oil supply structure in these scroll compressors includes oil supply holes formed through a fixed scroll to guide oil, which has been guided to an intermediate pressure chamber, to a compression chamber. The oil supply holes are formed to communicate with a first compression chamber formed between an inner surface of a fixed wrap and an outer surface of an orbiting wrap, and a second compression chamber formed between an outer surface of the fixed wrap and an inner surface of the orbiting wrap, respectively.

The oil supply hole communicating with the first compression chamber may be defined as a first oil supply hole and the oil supply hole communicating with the second compression chamber may be defined as a second oil supply hole. The first oil supply hole and the second oil supply hole are respectively formed at positions where they are open before a suction completion time point of each compression chamber. As the oil supply holes individually communicate with the first compression chamber and the second compression chamber, smooth oil supply to both compression chambers can be expected even during a low-pressure ratio operation.

However, if the first oil supply hole communicating with the first compression chamber and the second oil supply hole communicating with the second compression chamber are provided, a section in which the first oil supply hole and the second oil supply hole communicate with each other may be generated during an operation of the compressor. In the section where the first oil supply hole and the second oil supply hole communicate with each other, a part of refrigerant which is compressed in a compression chamber where pressure is high may flow back into a compression chamber where pressure is low due to such pressure difference between the first compression chamber and the second compression chamber. As a result, compression loss may occur due to leakage between the compression chambers. This may often occur in an operation of a low-pressure ratio which is less than 1.3.

SUMMARY

One aspect of the present disclosure is to provide a scroll compressor, capable of suppressing compression loss in a first compression chamber formed between an inner surface of a fixed wrap and an outer surface of an orbiting wrap, and a second compression chamber formed between an outer surface of the fixed wrap and an inner surface of the orbiting wrap.

Another aspect of the present disclosure is to provide a scroll compressor, capable of suppressing refrigerant compressed in a high-pressure compression chamber from flowing back toward a low-pressure compression chamber through an oil supply passage while oil supply passages individually communicate with a first compression chamber and a second compression to chamber.

Still another aspect of the present disclosure is to provide a scroll compressor, capable of preventing an oil supply passage communicating with a first compression chamber and an oil supply passage communicating with a second compression chamber from being simultaneously open to the respective compression chambers based on a crank angle, or minimizing a simultaneous open time.

Still another aspect of the present disclosure is to provide a scroll compressor, capable of preventing a first compression chamber and a second compression chamber from communicating with each other through an oil supply passage while oil is smoothly supplied to the first compression chamber and the second compression chamber during a low-pressure ratio operation.

In order to achieve these and other advantages and in accordance with the purpose of this specification, particular implementations of the present disclosure provide a scroll compressor that includes a casing, a driving motor provided in the casing, a fixed scroll, an orbiting scroll, and first and second compression chamber oil supply holes. The fixed scroll is disposed at a side of the driving motor and includes a fixed end plate and a fixed wrap positioned at the fixed end plate. The orbiting scroll includes an orbiting end plate facing the fixed end plate, and an orbiting wrap positioned at the orbiting end plate and configured to be engaged with the fixed wrap to define a first compression chamber and a second compression chamber. The first compression chamber oil supply hole is defined at the orbiting end plate and configured to be in fluid communication with the first compression chamber. The second compression chamber oil supply hole is defined at the orbiting end plate and configured to be in fluid communication with the second compression chamber. The first compression chamber oil supply hole is configured to be opened toward the first compression chamber during a first oil supply stage. The second compression chamber oil supply hole is configured to be opened toward the second compression chamber during a second oil supply stage. The first oil supply stage overlaps the second oil supply stage during a first period of time, and does not overlap the second oil supply stage during a second period of time. The second period of time is longer than the first period of time.

In some implementations, the scroll compressor can optionally include one or more of the following features. The first compression chamber oil supply hole may include a first outlet that is in fluid communication with the first compression chamber. The second compression chamber oil supply hole may include a second outlet that is in fluid communication with the second compression chamber. The first outlet and the second outlet may be located at portions of the orbiting end plate that restrict the first oil supply stage from overlapping the second oil supply stage. The first compression chamber may be defined between an inner circumferential surface of the fixed wrap and an outer circumferential surface of the orbiting wrap. The second compression chamber may be defined between an outer circumferential surface of the fixed wrap and an inner circumferential surface of the orbiting wrap. The first compression chamber oil supply hole may include a first outlet that is spaced apart by a first distance from an outer circumferential surface of an outermost orbiting wrap. The second compression chamber oil supply hole may include a second outlet that is spaced apart by a second distance from an inner circumferential surface of the outermost orbiting wrap. The first distance may be greater than or equal to the second distance. The first distance may be greater than or equal to a first value obtained by subtracting an inner diameter of the first outlet of the first compression chamber oil supply hole from a first wrap thickness of the orbiting wrap adjacent to the first outlet of the first compression chamber oil supply hole. The second distance may be greater than or equal to a second value obtained by subtracting an inner diameter of the second outlet of the second compression chamber oil supply hole from a second wrap thickness of the orbiting wrap adjacent to the second outlet of the second compression chamber oil supply hole. The first outlet of the first compression chamber oil supply hole may be spaced apart by a first distance from the outer circumferential surface of the outermost orbiting wrap. The first distance may be equal to or greater than an inner diameter of the first outlet of the first compression chamber oil supply hole. The second outlet of the second compression chamber oil supply hole may be spaced apart by a second distance from the inner circumferential surface of the outermost orbiting wrap. The second distance may be equal to or greater than an inner diameter of the second outlet of the second compression chamber oil supply hole. The second oil supply stage may start at an end of the first oil supply stage, and the first oil supply stage may start at a preset interval from an end of the second oil supply stage. The preset interval may correspond to a crank angle of greater than 0° and smaller than or equal to 30°. The first outlet of the first compression chamber oil supply hole may be defined at a first position that permits the first compression chamber oil supply hole to fluidly communicate with the first compression chamber based on a suction in the first compression chamber being completed. The second outlet of the second compression chamber oil supply hole may be defined at a second position that permits the second compression chamber oil supply hole to fluidly communicate with the second compression chamber based on a suction in the second compression chamber being competed. The first outlet of the first compression chamber oil supply hole may be configured, based on a crank angle being 0° at a position that an outer circumferential surface of a suction end of the orbiting wrap contacts an inner circumferential surface of the fixed wrap, to be defined in a first range that permits first pockets to overlap each other. The first pockets may define the first compression chamber respectively at crank angles of 0°, 90°, and 180°. The second outlet of the second compression chamber oil supply hole may be configured, based on the crank angle being 0° at the position that the outer circumferential surface of the suction end of the orbiting wrap contacts the inner circumferential surface of the fixed wrap, to be defined in a second range that permits second pockets to overlap each other. The second pockets may define the second compression chamber respectively at crank angles of 180°, 260°, and 320°. The second compression chamber oil supply hole may include a second outlet configured to be blocked with respect to the second compression chamber in the first oil supply stage. The first compression chamber oil supply hole may include a first outlet configured to be blocked with respect to the first compression chamber in the second oil supply stage. The first outlet of the first compression chamber oil supply hole may be configured to be defined in a crank angle range of 0° to 90° in a first pressure ratio stage. The second outlet of the second compression chamber oil supply hole may be configured to be defined in a crank angle range of 180° to 260° in the first pressure ratio stage. The first outlet of the first compression chamber oil supply hole may be configured to be defined in a crank angle range of 90° to 180° in a second pressure ratio stage. The second outlet of the second compression chamber oil supply hole may be configured to be defined in a crank angle range of 260° to 320° in the second pressure ratio stage. The second pressure ratio stage may be greater than the first pressure ratio stage. The first outlet of the first compression chamber oil supply hole may be configured to be defined in a crank angle range of 180° to 250° in a third pressure ratio stage. The second outlet of the second compression chamber oil supply hole may be configured to be defined in a crank angle range of 320° to 380° in the third pressure ratio stage. The third pressure ratio stage may be greater than the second pressure ratio stage. The orbiting scroll may include an oil accommodating portion that is in fluid communication with an inner space of the casing. The first compression chamber oil supply hole and the second compression chamber oil supply hole may be in fluid communication with the oil accommodating portion. The orbiting scroll may define a rotating shaft coupling portion through the orbiting scroll in an axial direction. The rotating shaft coupling portion may be configured to receive a rotating shaft. The scroll compressor may include an eccentric portion bearing that is fitted with an inner circumferential surface of the rotating shaft coupling portion. The eccentric portion bearing may be shorter in length than the rotating shaft coupling portion. The oil accommodating portion may be defined at an annular shape between an end of the eccentric portion bearing and the inner circumferential surface of the rotating shaft coupling portion. The scroll compressor may include a first pressure reducing member positioned in the first compression chamber oil supply hole, and a second pressure reducing member positioned in the second compression chamber oil supply hole. An outer diameter of the first pressure reducing member may be smaller than an inner diameter of the first compression chamber oil supply hole. An outer diameter of the second pressure reducing member may be smaller than an inner diameter of the second compression chamber oil supply hole.

In order to achieve these and other advantages and in accordance with the purpose of this specification, as embodied and broadly described herein, there is provided a scroll compressor, in which a first crank angle range is out of a second crank angle range under assumption that a crank angle range in which a first compression chamber oil supply hole is opened with respect to a first compression chamber is the first crank angle range and a crank angle range in which a second compression chamber oil supply hole is opened with respect to a second compression chamber is the second crank angle range. Accordingly, the first crank angle range and the second crank angle range do not overlap each other, which may prevent the first compression chamber and the second compression chamber from communicating with each other, thereby suppressing leakage between the compression chambers.

Here, an interval between the first crank angle range and the second crank angle range may be formed to be smaller than or equal to 10° based on a crank angle. This may result in minimizing a section in which oil is not supplied and thus reducing friction loss as much as possible.

In addition, in order to achieve those aspects and other advantages of the present disclosure, there is provided a scroll compressor, including a casing, a driving motor provided in an inner space of the casing, a fixed scroll disposed at one side of the driving motor and provided with a fixed end plate and a fixed wrap formed on one side surface of the fixed end plate, an orbiting scroll provided with an orbiting end plate facing the fixed end plate, and an orbiting wrap formed on one side surface of the orbiting end plate and engaged with the fixed wrap to form a first compression chamber and a second compression chamber, and first and second compression chamber oil supply holes formed through the orbiting end plate to communicate with the first compression chamber and the second compression chamber, respectively. Accordingly, oil can be supplied to the first compression chamber and the second compression chamber almost without interruption, thereby increasing reliability of the compressor.

For example, a section in which the first oil supply section and the second oil supply section do not overlap each other may be longer than a section in which the first oil supply section and the second oil supply section overlap each other. This may result in minimizing the communication between the first compression chamber and the second compression chamber through the first compression chamber oil supply hole and the second compression chamber oil supply hole.

Specifically, an outlet of the first compression chamber oil supply hole communicating with the first compression chamber and an outlet of the second compression chamber oil supply hole communicating with the second compression chamber may be formed at positions where the first oil supply section and the second oil supply section do not overlap each other. This may result in suppressing leakage between the first compression chamber and the second compression chamber through the first compression chamber oil supply hole and the second compression chamber oil supply hole.

Here, the first compression chamber may be formed between an inner circumferential surface of the fixed wrap and an outer circumferential surface of the orbiting wrap, and the second compression chamber may be formed between an outer circumferential surface of the fixed wrap and an inner circumferential surface of the orbiting wrap. An outlet of the first compression chamber oil supply hole may be formed at a position spaced apart by a first interval from an outer circumferential surface of an outermost orbiting wrap, and an outlet of the second compression chamber oil supply hole may be formed at a position spaced apart by a second interval from an inner circumferential surface of the outermost orbiting wrap. With the configuration, even during an operation of a low pressure ratio of less than 1.3, in an oil supply section for the first compression chamber and an oil supply section for the second compression chamber, a first oil supply section in which the first compression chamber oil supply hole is opened toward the first compression chamber may not overlap a second oil supply section in which the second compression chamber oil supply hole is opened toward the second compression chamber, thereby enhancing compression efficiency.

Here, the first interval may be greater than or equal to the second interval. Accordingly, the outlet of the first compression chamber oil supply hole and the outlet of the second compression chamber oil supply hole can be formed at positions where the first oil supply section and the second oil supply section do not overlap each other.

In addition, the first interval may be formed at a position equal to or greater than a value obtained by subtracting an inner diameter of the outlet of the first compression chamber oil supply hole from a wrap thickness of the orbiting wrap adjacent to the outlet of the first compression chamber oil supply hole. The second interval may be formed at a position equal to or greater than a value obtained by subtracting an inner diameter of the outlet of the second compression chamber oil supply hole from a wrap thickness of the orbiting wrap adjacent to the outlet of the second compression chamber oil supply hole. This may result in optimizing positions of the first compression chamber oil supply hole and the second compression chamber oil supply hole so that the first oil supply section and the second oil supply section do not overlap each other.

Here, the outlet of the first compression chamber oil supply hole may be formed at a position spaced apart from the outer circumferential surface of the outermost orbiting wrap by an inner diameter of the outlet of the first compression chamber oil supply hole or farther, and the outlet of the second compression chamber oil supply hole may be formed at a position spaced apart from the inner circumferential surface of the outermost orbiting wrap by an inner diameter of the outlet of the second compression chamber oil supply hole or farther.

The second oil supply section may start continuously from an end of the first oil supply section, and the first oil supply section may start at a preset interval from an end of the second oil supply section.

An interval between the start of the first oil supply section and the end of the second oil supply section may be greater than 0° and smaller than or equal to 30° based on a crank angle. Accordingly, a non-oil supply section can be minimized even without an overlap between the first oil supply section and the second oil supply section, thereby reducing friction loss of the compressor.

The outlet of the first compression chamber oil supply hole may be formed at a position where the first compression chamber oil supply hole communicates with the first compression chamber after a time point when a suction in the first compression chamber is completed, and the outlet of the second compression chamber oil supply hole may be formed at a position where the second compression chamber oil supply hole communicates with the second compression chamber after a time point when a suction in the second compression chamber is competed. This may result in suppressing an increase in a specific volume of refrigerant sucked by pressure of oil to be supplied, thereby reducing suction loss of the compressor.

When a crank angle of a position where an outer circumferential surface of a suction end of the orbiting wrap is in contact with an inner circumferential surface of the fixed wrap is 0°, the outlet of the first compression chamber oil supply hole may be formed in a range where pockets forming the first compression chamber respectively at crank angles of 0°, 90°, and 180° overlap, and the outlet of the second compression chamber oil supply hole may be formed in a range where pockets forming the second compression chamber respectively at crank angles of 180°, 260°, and 320° overlap. Accordingly, the first compression chamber oil supply hole and the second compression chamber oil supply hole can communicate with the compression chambers, respectively, at arbitrary crank angles.

An outlet of the second compression chamber oil supply hole may be blocked with respect to the second compression chamber in the first oil supply section, and an outlet of the first compression chamber oil supply hole may be blocked with respect to the first compression chamber in the second oil supply section. This may prevent the first compression chamber and the second compression chamber from communicating with each other through the compression chamber oil supply holes.

The outlet of the first compression chamber oil supply hole may be formed in a range of 0° to 90° and the outlet of the second compression chamber oil supply hole may be formed in a range of 180° to 260° in a first pressure ratio section. The outlet of the first compression chamber oil supply hole may be formed in a range of 90° to 180° and the outlet of the second compression chamber oil supply hole may be formed in a range of 260° to 320° in a second pressure ratio section greater than the first pressure ratio section. The outlet of the first compression chamber oil supply hole may be formed in a range of 180° to 250° and the outlet of the second compression chamber oil supply hole may be formed in a range of 320° to 380° in a third pressure ratio section greater than the second pressure ratio section. Accordingly, within an arbitrary pressure ratio range, the first compression chamber oil supply hole and the second compression chamber oil supply hole can be formed at positions where the oil supply holes communicate with the compression chambers, respectively, so as to prevent leakage between the compression chambers and minimize interruption of oil supply to each compression chamber.

Here, the first compression chamber oil supply hole and the second compression chamber oil supply hole may be formed through the orbiting end plate.

In this case, the orbiting scroll may be provided with an oil accommodating portion communicating with the inner space of the casing, and the first compression chamber oil supply hole and the second compression chamber oil supply hole may communicate with the oil accommodating portion.

The orbiting scroll may be provided with a rotating shaft coupling portion formed therethrough in an axial direction such that a rotating shaft is inserted. An eccentric portion bearing may be fitted onto an inner circumferential surface of the rotating shaft coupling portion. The eccentric portion bearing may be formed to be shorter than the rotating shaft coupling portion in length, such that the oil accommodating portion can be formed in an annular shape between an end of the eccentric portion bearing and the inner circumferential surface of the rotating shaft coupling portion.

A first pressure reducing member may be provided in the first compression chamber oil supply hole, and a second pressure reducing member may be provided in the second compression chamber oil supply hole. An outer diameter of the first pressure reducing member may be smaller than an inner diameter of the first compression chamber oil supply hole, and an outer diameter of the second pressure reducing member may be smaller than an inner diameter of the second compression chamber oil supply hole.

DETAILED DESCRIPTION

Description will now be given in detail of a scroll compressor according to exemplary embodiments disclosed herein, with reference to the accompanying drawings. Hereinafter, a description will be given by defining an axial direction and a radial direction based on a rotating shaft. That is, for the sake of explanation, a lengthwise direction of a rotating shaft is defined as the axial direction (or gravity direction) of the compressor, and a transverse direction of the rotating shaft is defined as a radius of the compressor.

In addition, a description will be given of a high-pressure type scroll compressor, which is a vertical type scroll compressor with a motor unit and a compression unit arranged in a vertical direction and is also a bottom-compression type scroll compressor with the compression unit located below the motor unit, and in which a refrigerant suction pipe is directly connected to the compression unit and a refrigerant discharge pipe communicates with an inner space of a casing.

Figure 1:
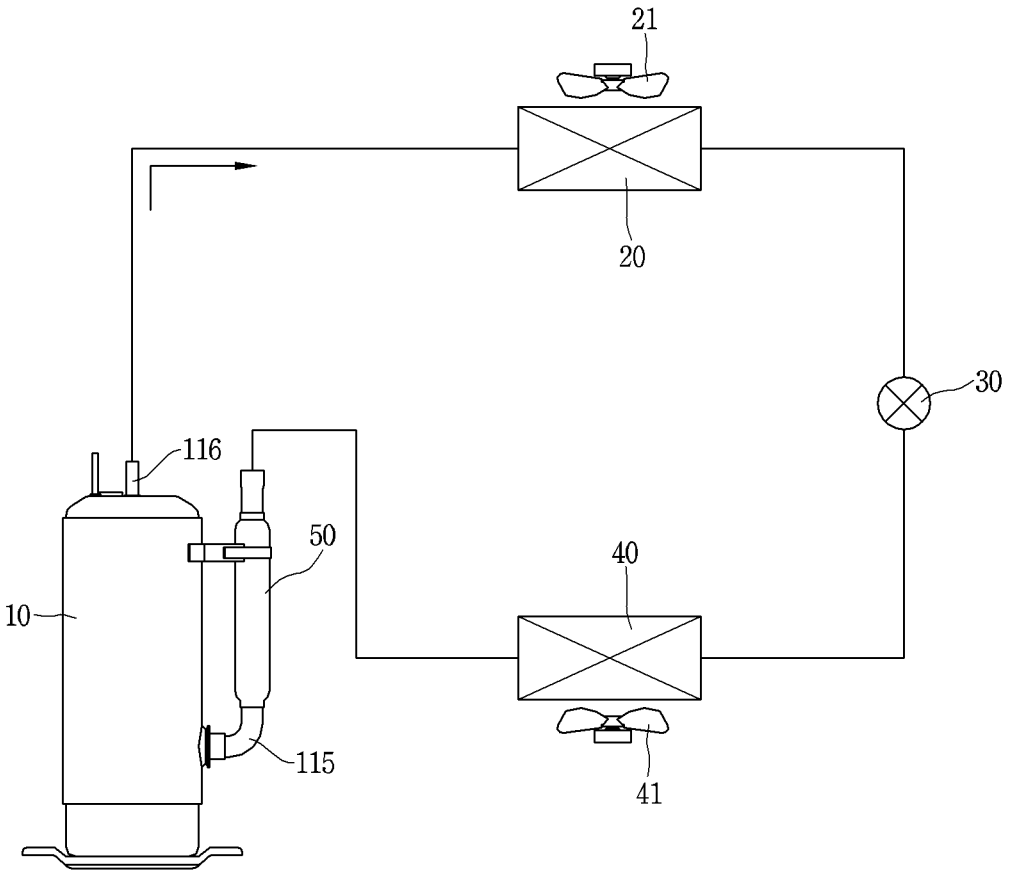
FIG. 1 is a diagram illustrating a refrigeration cycle apparatus to which a bottom-compression type scroll compressor in accordance with one implementation of the present disclosure is applied.

FIG. 1 is a diagram illustrating a refrigeration cycle apparatus to which a bottom-compression type scroll compressor in accordance with one implementation of the present disclosure is applied.

Referring to FIG. 1, a refrigeration cycle apparatus to which the scroll compressor according to the implementation is applied may be configured such that a compressor 10, a condenser 20, an expansion apparatus 30, and an evaporator 40 define a closed loop. The condenser 20, the expansion apparatus 30, and the evaporator 40 may be sequentially connected to a discharge side of the compressor 10 and a discharge side of the evaporator 40 may be connected to a suction side of the compressor 10.

Accordingly, refrigerant compressed in the compressor 10 may be discharged toward the condenser 20, and then sucked back into the compressor 10 sequentially through the expansion apparatus 30 and the evaporator 40. The series of processes may be repeatedly carried out.

Figure 2:
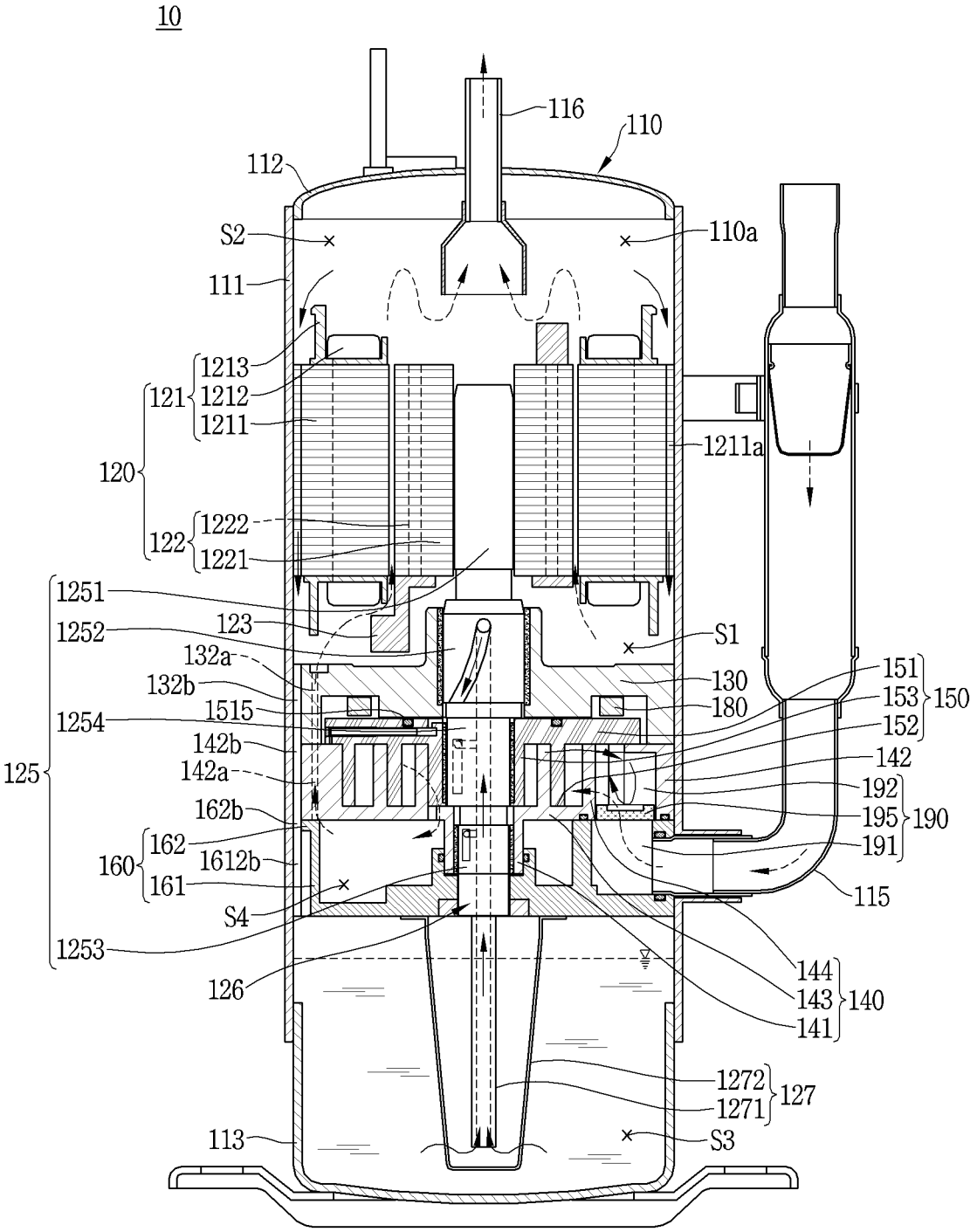
FIG. 2 is a longitudinal sectional view of a bottom-compression type scroll compressor in accordance with an implementation.
Figure 3:
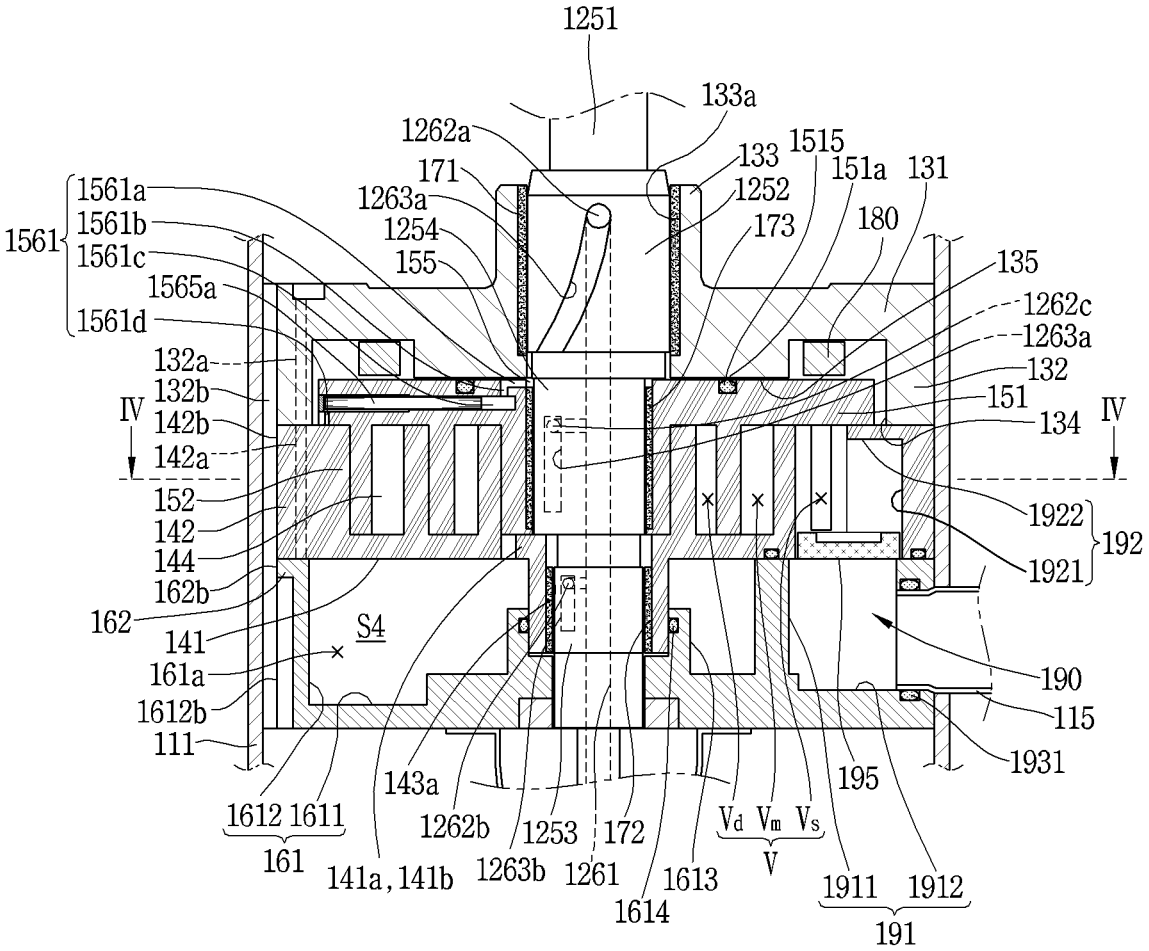
FIG. 3 is an enlarged longitudinal sectional view of a compression unit in FIG. 2.
Figure 4:
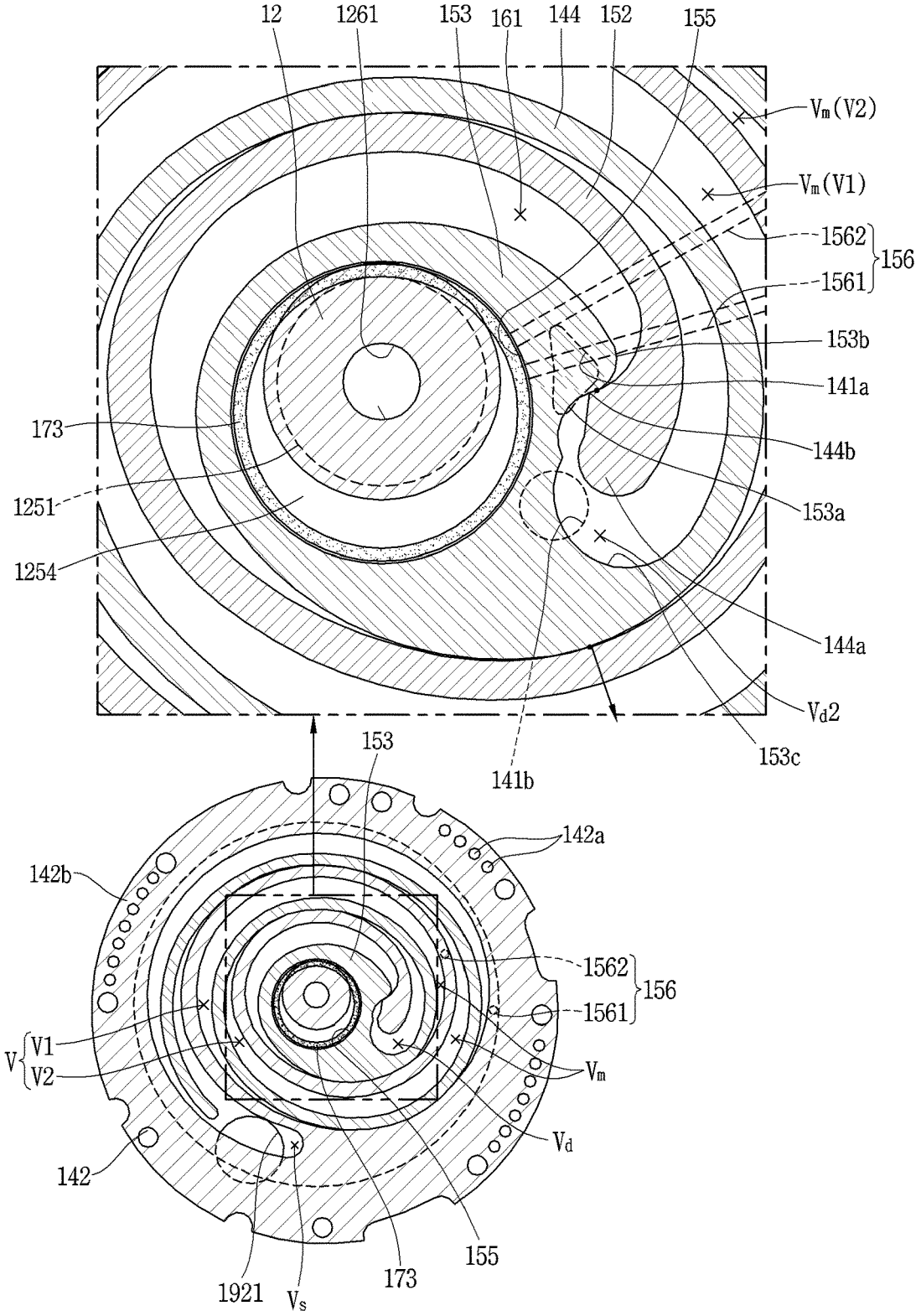
FIG. 4 is a sectional view taken along the line "IV-IV" of FIG. 3.

FIG. 2 is a longitudinal view illustrating a bottom-compression type scroll compressor in accordance with an implementation of the present disclosure, FIG. 3 is an enlarged longitudinal view illustrating a compression unit in FIG. 2, and FIG. 4 is a sectional view taken along the line "IV-IV" of FIG. 3.

Referring to these drawings, the scroll compressor according to the implementation of the present disclosure is of a high-pressure type and a bottom-compression type. Hereinafter, it will be abbreviated as a scroll compressor and described.

A scroll compressor according to an implementation may include a driving motor 120 disposed in an upper portion of a casing 110, and a main frame 130, an orbiting scroll 150, a fixed scroll 140, and a discharge cover 160 sequentially disposed below the driving motor 120. In general, the driving motor 120 may constitute a motor unit, and the main frame 130, the orbiting scroll 150, the fixed scroll 140, and the discharge cover 160 may constitute a compression unit.

The motor unit may be coupled to an upper end of a rotating shaft 125 to be explained later, and the compression unit may be coupled to a lower end of the rotating shaft 125. Accordingly, the compressor 10 may have the bottom-compression type structure described above, and the compression unit may be connected to the motor unit by the rotating shaft 125 to be operated by a rotational force of the motor unit.

Referring to FIG. 2, the casing 110 according to the implementation may include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111.

Accordingly, the inner space 110*a* of the casing 110 may be sealed. The sealed inner space 110*a* of the casing 110 may be divided into a lower space S1 and an upper space S2 based on the driving motor 120. An oil storage space S3 may be separately defined below the lower space S1 based on the compression unit. The lower space S1 may define a discharge space, and the upper space S2 may define an oil separation space.

The driving motor 120 and the main frame 130 may be fixedly inserted into the cylindrical shell 111. An outer circumferential surface of the driving motor 120 and an outer circumferential surface of the main frame 130 may be spaced apart from an inner circumferential surface of the cylindrical shell 111 by a preset interval, thereby defining an oil recovery passage (no reference numeral given). This will be described again later together with the oil recovery passage.

A refrigerant suction pipe 115 may be coupled through a side surface of the cylindrical shell 111. The refrigerant suction pipe 115 may be coupled through the cylindrical shell 111 forming the casing 110 in a radial direction.

The refrigerant suction pipe 115 may be formed in an L-like shape. One end of the refrigerant suction pipe 115 may be coupled through the cylindrical shell 111 so as to communicate directly with a first suction passage 1912 of the discharge cover 160 to be explained later, which defines a compression unit. In other words, the refrigerant suction pipe 115 may be connected to a suction passage 190 to be described later at a position lower than a compression chamber V in an axial direction. Accordingly, in this implementation, as the suction passage 190 is formed in the oil storage space S3 which is an empty space below the compression unit, a suction passage opening and closing valve 195 to be described later may be disposed to operate in the axial direction in a bottom-compression manner, without extending a length of the compressor.

Another end of the refrigerant suction pipe 115 may be connected to an accumulator 50 outside the cylindrical shell 111. The accumulator 50 may be connected to an outlet side of the evaporator 40 through a refrigerant pipe. Accordingly, while refrigerant flows from the evaporator 40 to the accumulator 50, liquid refrigerant may be separated in the accumulator 50, and only gaseous refrigerant may be directly introduced into the compression chamber V through the refrigerant suction pipe 115.

A terminal bracket (not shown) may be coupled to an upper portion of the cylindrical shell 111 or the upper shell 112, and a terminal (not shown) for transmitting external power to the driving motor 120 may be coupled through the terminal bracket.

A refrigerant discharge pipe 116 may be coupled through an upper portion of the upper shell 112 to communicate with the inner space 110*a* of the casing 110. The refrigerant discharge pipe 116 may correspond to a passage through which compressed refrigerant discharged from the compression unit to the inner space 110*a* of the casing 110 is externally discharged toward the condenser 20.

The refrigerant discharge pipe 116 may be provided therein with an oil separator (not shown) for separating oil from refrigerant discharged from the compressor 10 to the condenser 20, or a check valve (not shown) for suppressing refrigerant discharged from the compressor 10 from flowing back into the compressor 10.

Hereinafter, a driving motor constituting the motor unit will be described.

Referring to FIG. 2, the driving motor 120 according to the implementation may include a stator 121 and a rotor 122. The stator 121 may be fixed onto the inner circumferential surface of the cylindrical shell 111, and the rotor 122 may be rotatably disposed in the stator 121.

The stator 121 may include a stator core 1211 and a stator coil 1212.

The stator core 1211 may be formed in a cylindrical shape and may be shrink-fitted onto the inner circumferential surface of the cylindrical shell 111. A plurality of recessed surfaces may be formed in a D-cut shape recessed into an outer circumferential surface of the stator core 1211 along the axial direction, and disposed at preset intervals along a circumferential direction.

The recessed surfaces 1211*a* may be spaced apart from the inner circumferential surface of the cylindrical shell 111 to define a first oil recovery passage (not shown) through which oil passes. Accordingly, oil separated from refrigerant in the upper space S2 may move to the lower space S1 through the first oil recovery passage, and then return into the oil storage space S3 through a second oil recovery passage (no reference numeral given).

The stator coil 1212 may be wound around the stator core 1211 and may be electrically connected to an external power source through a terminal (not shown) that is coupled through the casing 110. An insulator 1213, which is an insulating member, may be inserted between the stator core 1211 and the stator coil 1212.

The insulator 1213 may extend long to both sides in the axial direction to accommodate a bundle of the stator coil 1212 in the radial direction, and a portion of the insulator 1213 which extends downwardly may configure an oil separation portion (no reference numeral given) to prevent refrigerant discharged into the lower space S1 from being mixed with oil recovered from the upper space S2.

The rotor 122 may include a rotor core 1221 and permanent magnets 1222.

The rotor core 1221 may be formed in a cylindrical shape, and may be rotatably inserted into the stator core 1211 with a preset gap therebetween. The permanent magnets 1222 may be embedded in the rotor core 1221 at preset intervals along a circumferential direction.

In addition, a balance weight 123 may be coupled to a lower end of the rotor core 1221. Alternatively, the balance weight 123 may be coupled to a shaft portion 1251 of a rotating shaft 125 to be described later.

The rotating shaft 125 may be coupled to the center of the rotor 122. An upper end portion of the rotating shaft 125 may be press-fitted into the rotor 122, and a lower end portion may be rotatably inserted into the main frame 130 to be supported in the radial direction.

The main frame 130 may be provided with a main bearing 171 configured as a bush bearing to support the lower end portion of the rotating shaft 125. Accordingly, the rotating shaft 125 may transfer the rotational force of the motor unit 120 to the orbiting scroll 150 of the compression unit. Accordingly, the orbiting scroll 150 eccentrically coupled to the rotating shaft 125 may perform an orbiting motion with respect to the fixed scroll 140.

Referring to FIG. 2, the rotating shaft 125 may include a shaft portion 1251, a first bearing portion 1252, a second bearing portion 1253, and an eccentric portion 1254.

The shaft portion 1251 may be a portion constituting the upper half of the rotating shaft 125. The shaft portion 1251 may be formed in a solid cylindrical shape, and the rotor 122 may be press-fitted into an upper portion of the shaft portion 1251.

The first bearing portion 1252 may be a portion extending from a lower end of the shaft portion 1251. The first bearing portion 1252 may be inserted into a main bearing hole 133*a* of the main frame 130 to be described later so as to be supported in the radial direction.

The second bearing portion 1253 may be a portion corresponding to a lower end of the shaft portion 1251. The second bearing portion 1253 may be inserted into a sub bearing hole 143*a* of the fixed scroll 140 to be described later so as to be supported in the radial direction. The second bearing portion 1253 may be coaxially disposed with respect to the first bearing portion 1252 so as to have the same axial center.

The eccentric portion 1254 may be formed between a lower end of the first bearing portion 1252 and an upper end of the second bearing portion 1253. The eccentric portion 1254 may be inserted into a rotating shaft coupling portion 333 of the orbiting scroll 150 to be described later.

The eccentric portion 1254 may be eccentric with respect to the first bearing portion 1252 or the second bearing portion 1253 in the radial direction. Accordingly, when the rotating shaft 125 rotates, the orbiting scroll 150 may perform an orbiting motion with respect to the fixed scroll 140.

Meanwhile, the rotating shaft 125 may include an oil supply passage 126 formed therein to supply oil to the first bearing portion 1252, the second bearing portion 1252, and the eccentric portion 1254. The oil supply passage 126 may include an inner oil passage 1261 formed in the rotating shaft along the axial direction.

As the compression unit is located below the motor unit 120, the inner oil passage 1261 may be formed in a grooving manner from the lower end of the rotating shaft 125 approximately to a lower end or a middle height of the stator 121 or up to a position higher than an upper end of the first bearing portion 1252. Of course, according to circumstances, the inner oil passage 1261 may also be formed through the rotating shaft 125 in the axial direction.

In addition, an oil feeder 127 for pumping up oil filled in the oil storage space S3 may be coupled to the lower end of the rotating shaft 125, namely, a lower end of the second bearing portion 1253. The oil feeder 127 may include an oil suction pipe 1271 inserted into the inner oil passage 1261 of the rotating shaft 125, and a blocking member 1272 accommodating the oil supply pipe 1271 to block an introduction of foreign materials. The oil suction pipe 1271 may extend downward through the discharge cover 160 to be immersed in the oil filled in the oil storage space S3.

The rotating shaft 125 may be provided with a plurality of oil holes communicating with the inner oil passage 1261 to guide oil moving upward along the inner oil passage 1261 toward the first and second bearing portions 1252 and 1253 and the eccentric portion 1254.

The plurality of oil holes may penetrate from an inner circumferential surface of the inner oil passage 1261 to outer circumferential surfaces of the bearing portions 1252 and 1253 and the eccentric portion 1254. The plurality of oil holes may constitute the oil supply passage 126 together with the inner oil passage 1261, and include a first oil hole 1262*a*, a second oil hole 1262*b*, and a third oil hole 1262*c*.

The first oil hole 1262*a* may be formed from the inner circumferential surface of the inner oil passage 1261 to the outer circumferential surface of the first bearing portion 1252 in a penetrating manner, and the second oil hole 1262*b* may be formed from the inner circumferential surface of the inner oil passage 1261 to the outer circumferential surface of the second bearing portion 1253 in a penetrating manner, and the third oil hole 1262*c* may be formed from the inner circumferential surface of the inner oil passage 1261 to the outer circumferential surface of the eccentric portion 1254 in a penetrating manner. In other words, the second oil hole 1262*b*, the third oil hole 1262*c*, and the first oil hole 1262*a* may be sequentially formed from the lower end to the upper end of the rotating shaft 125.

In addition, a first oil groove 1263*a* may be formed on the outer circumferential surface of the first bearing portion 1252. The first oil groove 1263*a* may communicate with the inner oil passage 1261 through the first oil hole 1262*a*. A second oil groove 1263*b* may be formed on the second bearing portion 1253 of the rotating shaft 125. The second oil groove 1263*b* may communicate with the inner oil passage 1261 through the second oil hole 1262*b*.

In addition, a third oil groove 1263*c* may be formed on the outer circumferential surface of the eccentric portion 1254. The third oil groove 1263*c* may communicate with the inner oil passage 1261 through the third oil hole 1262*c*. Accordingly, oil which moves from the inner oil passage 1261 to each of the oil grooves 1263*a*, 1263*b*, and 1263*c* through each of the oil holes 1262*a*, 1262*b*, and 1262*c* may be evenly spread on the outer circumferential surface of each of the bearing portions 1252 and 1253 and the outer circumferential surface of the eccentric portion 1254, thereby lubricating each bearing surface.

Here, the oil moving to the first oil groove 1263*a* of the first bearing portion 1252 or the oil moving to the third oil groove 1263*c* of the eccentric portion 1254 may flow to an oil accommodating portion 155 to be described later. And, this oil may be supplied to the compression chamber through a compression chamber oil supply hole 156 provided in the orbiting scroll 150 to be described later. The compression chamber oil supply hole will be described again later together with the orbiting scroll.

Figure 5:
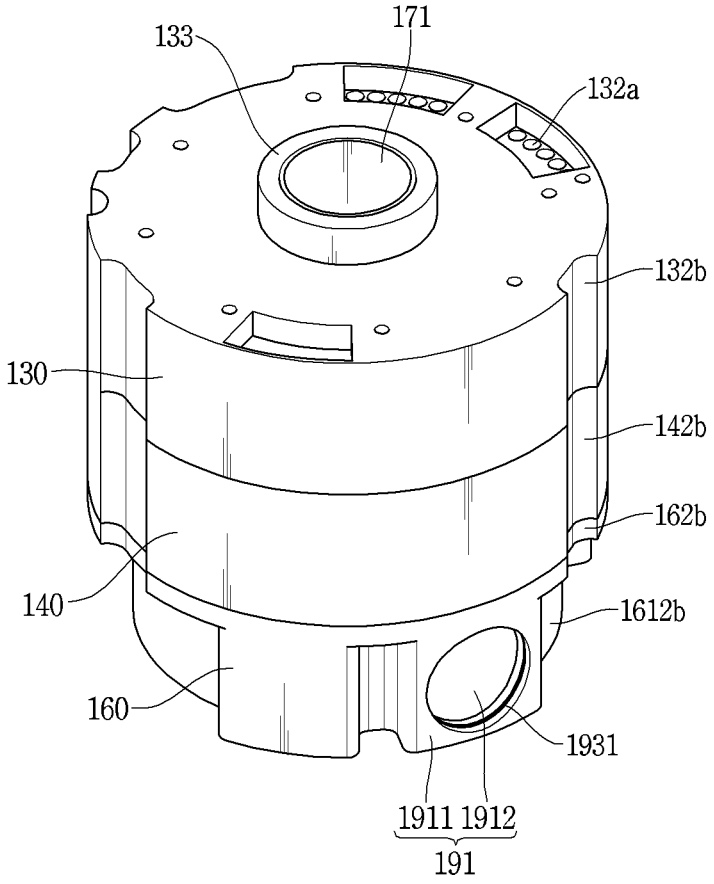
FIG. 5 is an assembled perspective view of a compression unit in accordance with an implementation.

Hereinafter, the compression unit will be described. FIG. 5 is a perspective view of a compression unit in an assembled state in accordance with an implementation, FIG. 6 is an exploded perspective view of the compression unit according to FIG. 5, viewed from the top, and FIG. 7 is an exploded perspective view of the compression unit according to FIG. 5, viewed from the bottom.

Figure 6:
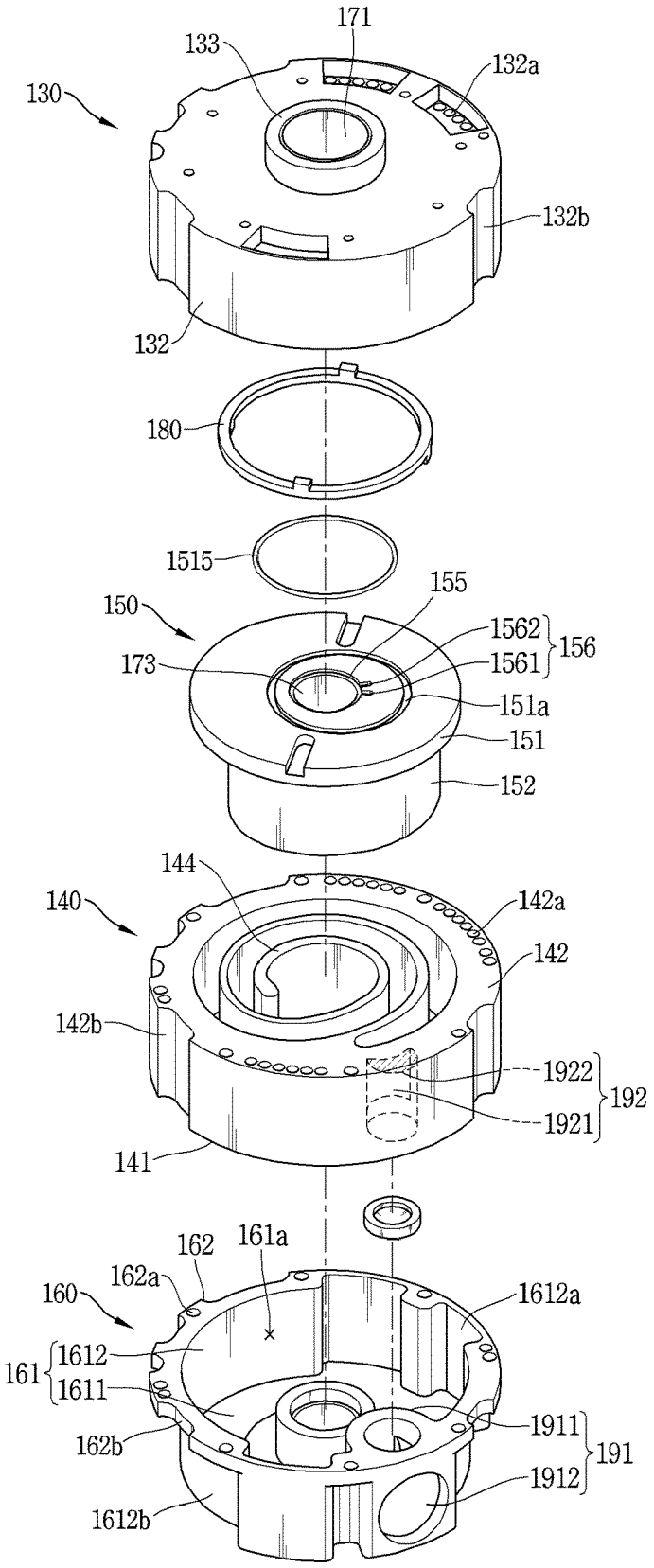
FIG. 6 is an exploded perspective view of the compression unit according to FIG. 5, viewed from the top.
Figure 7:
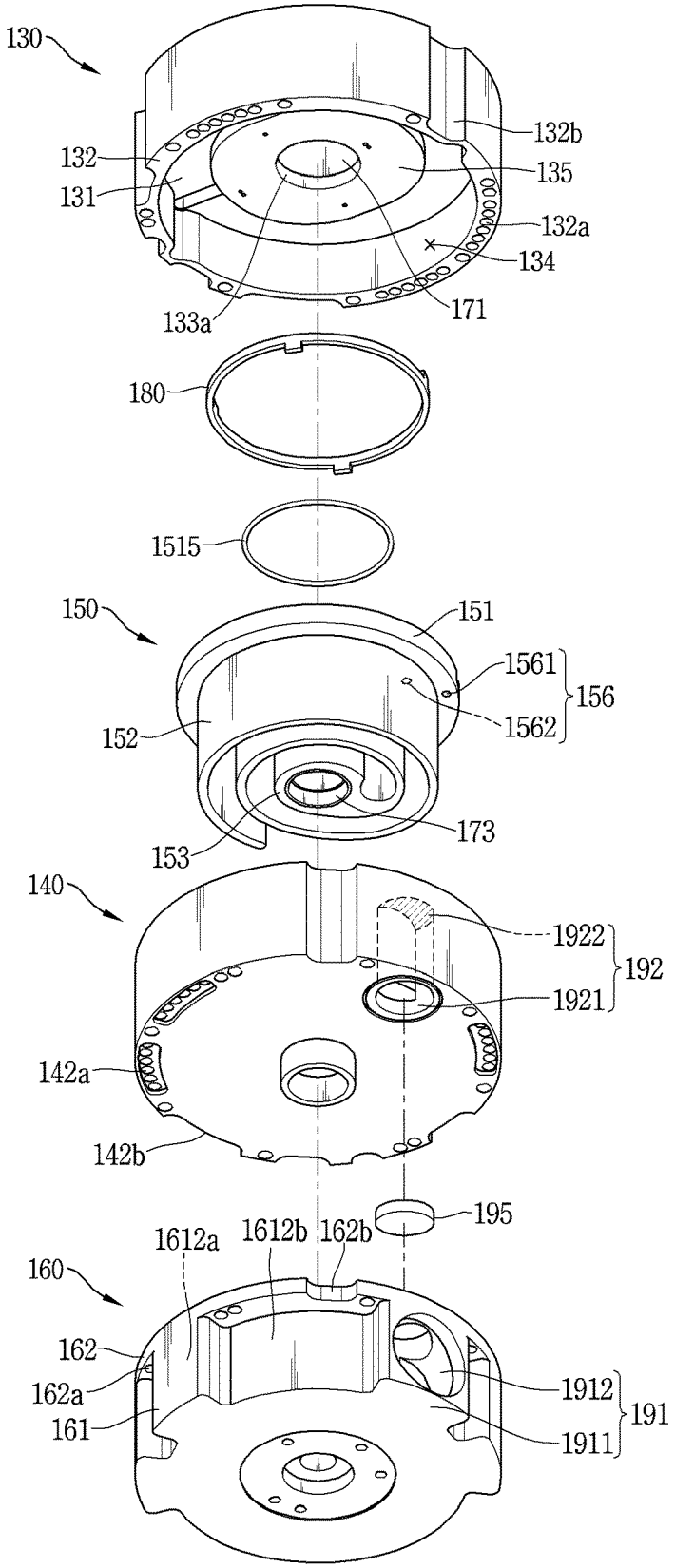
FIG. 7 is an exploded perspective view of the compression unit according to FIG. 5, viewed from the bottom.

Referring to FIGS. 5 to 7, the main frame 130 according to the implementation may include a frame end plate 131, a frame side wall portion 132, a main bearing portion 133, a scroll accommodating portion 134, and a scroll support portion 135.

The frame end plate 131 may be formed in an annular shape and installed below the driving motor 120. Accordingly, the lower space S1 of the casing 110 may be separated from the oil storage space S3 by the frame end plate 131.

The frame side wall portion 132 may extend in a cylindrical shape from an edge of a lower surface of the frame end plate 131, and an outer circumferential surface of the frame side wall portion 132 may be fixed to the inner circumferential surface of the cylindrical shell 111 in a shrink-fitting or welding manner.

A scroll accommodating portion 134 to be explained later may formed inside the frame side wall portion 132. The orbiting scroll 150 to be described later may be accommodated in the scroll accommodating portion 134 so as to perform an orbiting motion. To this end, an inner diameter of the frame side wall portion 132 may be greater than an outer diameter of an orbiting end plate 151 to be described later.

A plurality of frame discharge holes 132*a* may be formed at the frame side wall portion 132. The plurality of frame discharge holes 132*a* may be formed through the frame side wall portion 132 in the axial direction and disposed at preset intervals along a circumferential direction.

The frame discharge holes (hereinafter, referred to as second discharge holes) 132*a* may be formed to correspond to scroll discharge holes 142*a* of the fixed scroll 140 to be described later, and define a first refrigerant discharge passage (no reference numeral given) together with the scroll discharge holes 142*a*.

Also, a plurality of frame oil recovery grooves (hereinafter, referred to as first oil recovery grooves) 132*b* may be formed on an outer circumferential surface of the frame side wall portion 132 with the second discharge holes 132*a* interposed therebetween. The plurality of first oil recovery grooves 132*b* may be formed in the axial direction at preset intervals along the circumferential direction.

The first oil recovery grooves 132*b* may be formed to correspond to scroll oil recovery groove 142*b* of the fixed scroll 140, which will be described later, and define a second oil recovery passage together with the scroll oil recovery grooves 142*b* of the fixed scroll 140.

The main bearing portion 133 may protrude upward from an upper surface of a central portion of the frame end plate 131 toward the driving motor 120. The main bearing portion 133 may be provided with a main bearing hole 133*a* formed therethrough in a cylindrical shape along the axial direction. A main bearing 171 configured as a bush bearing may be firmly fitted onto an inner circumferential surface of the main bearing hole 133*a*. The main bearing portion 133 of the rotating shaft 125 may be fitted onto the main bearing 171 to be supported in the radial direction.

The scroll accommodating portion 134 may be a space defined by a lower surface of the frame end plate 131 and the inner circumferential surface of the frame side wall portion 132. An orbiting end plate 151 of the orbiting scroll 150 to be described later may be supported in the axial direction by the lower surface of the frame end plate 131, and accommodated in the frame side wall portion 132 in a manner that its outer circumferential surface is spaced apart from the inner circumferential surface of the frame side wall portion 132 by a preset interval (for example, an orbiting radius). Accordingly, the inner diameter of the frame side wall portion 132 constituting the scroll accommodating portion 134 may be greater than the outer diameter of the orbiting end plate 151 by the orbiting radius or more.

In addition, the frame side wall portion 132 defining the scroll accommodating portion 134 may have a height (depth) that is greater than or equal to a thickness of the orbiting end plate 151. Accordingly, while the frame side wall portion 132 is supported on the upper surface of the fixed scroll 140, the orbiting scroll 150 may perform an orbiting motion in the scroll accommodating portion 134.

The scroll support portion 135 may be formed in an annular shape on the lower surface of the frame end plate 131 that faces the orbiting end plate 151 of the orbiting scroll 150 to be described later. Accordingly, an Oldham ring 180 may be pivotably inserted between an outer circumferential surface of the scroll support portion 135 and the inner circumferential surface of the frame side wall portion 132.

In addition, the scroll support portion 135 may have a lower surface formed flat, so that a back pressure sealing member 1515 provided on the orbiting end plate 151 of the orbiting scroll 150 to be described later is in contact with the lower surface in a sliding manner.

The back pressure sealing member 1515 may be formed in an annular shape, thereby defining an oil accommodating portion 155 between the scroll support portion 135 and the orbiting end plate 151. Accordingly, oil flowing into the oil accommodating portion 155 through the third oil hole 1262*c* of the rotating shaft 125 may be introduced into the compression chamber V through a compression chamber oil supply hole 156 of the orbiting scroll 150 to be described later.

Hereinafter, the fixed scroll will be described.

Referring to FIGS. 5 to 7 again, the fixed scroll 140 according to the implementation may include a fixed end plate 141, a fixed side wall portion 142, a sub bearing portion 143, and a fixed wrap 144.

The fixed end plate 141 may be formed approximately in a disk shape, and a sub bearing hole 143*a* forming the sub bearing portion 143 to be described later may be formed through a center of the fixed end plate 141 in the axial direction. Discharge ports 141*a* and 141*b* may be formed around the sub bearing hole 143*a*. The discharge ports 141*a* and 141*b* may communicate with a discharge chamber Vd so that compressed refrigerant is moved into a discharge space S4 of the discharge cover 160 to be explained later.

Only one discharge port may be provided to communicate with both of a first compression chamber V1 and a second compression chamber V2 to be described later. In the illustrated implementation, however, the first discharge port 141*a* may communicate with the first compression chamber V1 and the second discharge port 141*b* may communicate with the second compression chamber V2. Accordingly, refrigerant compressed in the first compression chamber V1 and refrigerant compressed in the second compression chamber V2 may be independently discharged through the different discharge ports.

The fixed side wall portion 142 may extend in an annular shape from an edge of an upper surface of the fixed end plate 141 in the axial direction. The fixed side wall portion 142 may be coupled to face the frame side wall portion 132 of the main frame 31 in the axial direction.

A plurality of scroll discharge holes (hereinafter, referred to as first discharge holes) 142*a* may be formed through the fixed side wall portion 142 in the axial direction and communicate with the frame discharge holes 132*a* to define the first refrigerant discharge passage together with the frame discharge holes 132*a*.

Scroll oil recovery grooves (hereinafter, referred to as second oil recovery grooves) 142*b* may be formed on the outer circumferential surface of the fixed side wall portion 142. The second oil recovery grooves 142*b* may communicate with the first oil recovery grooves 132*b* provided at the main frame 130 to guide oil recovered along the first oil recovery grooves 132*b* to the oil storage space S3. Accordingly, the first oil recovery grooves 132*b* and the second oil recovery grooves 142*b* may define the second oil recovery passage together with oil recovery grooves 1612*b* and 162*b* of a flange portion 162 to be described later.

Meanwhile, a second suction passage 1921 may be formed in the fixed side wall portion 142 to communicate with a first suction passage 1912 formed in the discharge cover 160 to be described later. The second suction passage 1921 may define a suction port.

The second suction passage 1921 may be formed within a range of a suction chamber Vs of the compression unit to communicate with the suction chamber Vs. A suction passage opening and closing valve 195 may be installed in the second suction passage 1921 to selectively open or close a suction passage 190 which includes the second suction passage 1921 and the first suction passage 1912. The suction passage opening and closing valve 195 may also be referred to as a non-return valve, a suction valve, or a check valve.

The suction passage opening and closing valve 195 may be provided at a boundary surface between the first suction passage 1912 and the second suction passage 1921 to allow a fluid movement from the first suction passage 1912 to the second suction passage 1921 while blocking a reverse fluid movement from the second suction passage 1921 to the first suction passage 1912.

Accordingly, during the operation of the compressor, refrigerant sucked through the refrigerant suction pipe 115 may be introduced into the suction chamber Vs through the suction passage 190 including the first suction passage 1912 and the second suction passage 1921. On the other hand, when the compressor is stopped, the suction passage opening and closing valve 195 may close the suction passage 190 so that high-temperature oil contained in the oil storage space of the casing can be prevented from flowing back into the refrigerant suction pipe 115 together with high-temperature refrigerant compressed in the compression chamber. The suction passage including the second suction passage will be described later.

The sub bearing portion 143 may extend in the axial direction from a central portion of the fixed end plate 141 toward the discharge cover 160. The sub bearing portion 143 may be provided with a sub bearing hole 143*a* formed in a cylindrical shape through a center thereof along the axial direction. A sub bearing 172 configured as a bush bearing may be fitted onto an inner circumferential surface of the sub bearing hole 143*a*.

Therefore, the lower end of the rotating shaft 125 may be inserted into the sub bearing portion 143 of the fixed scroll 140 to be supported in the radial direction, and the eccentric portion 1254 of the rotating shaft 125 may be supported by the upper surface of the fixed end plate 141 defining the surrounding of the sub bearing portion 143.

A fixed wrap 144 may extend from the upper surface of the fixed end plate 141 toward the orbiting scroll 150 in the axial direction. The fixed wrap 144 may be engaged with an orbiting wrap 152 to be described later to define the compression chamber V. The fixed wrap 144 will be described later together with the orbiting wrap 152.

Hereinafter, the orbiting scroll will be described.

Referring to FIGS. 5 to 7, the orbiting scroll 150 according to the implementation may include an orbiting end plate 151, an orbiting wrap 152, and a rotating shaft coupling portion 153.

The orbiting end plate 151 may be formed approximately in a disk shape. A back pressure sealing groove 151*a* into which the back pressure sealing member 1515 is inserted may be formed in an upper surface of the orbiting end plate 151. The back pressure sealing groove 151*a* may be formed at a position facing the scroll support portion 135 of the main frame 130.

The back pressure sealing groove 151*a* may be formed in an annular shape to surround a rotating shaft coupling portion 153 to be described later, and may be eccentric with respect to an axial center of the rotating shaft coupling portion 153. Accordingly, even if the orbiting scroll 150 performs an orbiting motion, a back pressure chamber (no reference numeral given) having a constant range may be defined between the orbiting scroll 150 and the scroll support portion 135 of the main frame 130.

The orbiting end plate 151 may be further provided with a compression chamber oil supply hole 156. One end of the compression chamber oil supply hole 156 may communicate with the oil accommodating portion 155, and another end may communicate with an intermediate pressure chamber of the compression chamber. Accordingly, oil stored in the oil accommodating portion 155 may be supplied to the compression chamber V through the compression chamber oil supply hole 156 to lubricate the compression chamber.

The orbiting wrap 152 may extend from a lower surface of the orbiting end plate 151 toward the fixed scroll 140. The orbiting wrap 152 may be engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape. For example, as illustrated in FIG. 4, the orbiting wrap 152 may be formed in a substantially elliptical shape in which a plurality of arcs having different diameters and origins are connected and the outermost curve may have a major axis and a minor axis. The fixed wrap 144 may also be formed in a similar manner.

An inner end portion of the orbiting wrap 152 may be formed at a central portion of the orbiting end plate 151, and the rotating shaft coupling portion 153 may be formed through the central portion of the orbiting end plate 151 in the axial direction.

The eccentric portion 1254 of the rotating shaft 125 may be rotatably inserted into the rotating shaft coupling portion 153. An outer circumferential part of the rotating shaft coupling portion 153 may be connected to the orbiting wrap 152 to form the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric portion 1254 of the rotating shaft 125 overlaps the orbiting wrap 152 on the same plane. Accordingly, repulsive force and compressive force of refrigerant may cancel each other while being applied to the same plane based on the orbiting end plate 151, and thus inclination of the orbiting scroll 150 due to interaction between the compressive force and the repulsive force may be suppressed.

In addition, the rotating shaft coupling portion 153 may be provided with a concave portion 153*a* that is formed on an outer circumferential surface thereof, namely, an outer circumferential surface facing an inner end portion of the fixed wrap 144, to be engaged with a protruding portion 144*a* of the fixed wrap 144 to be described later. A convex portion 153*b* may be formed at one side of the concave portion 153*a*. The convex portion 153*b* may be formed at an upstream side along a direction in which the compression chamber V is formed, and have a thickness increasing from an inner circumferential surface to an outer circumferential surface of the rotating shaft coupling portion 153.

This may extend a compression path of the first compression chamber V1 immediately before discharge, and consequently the compression ratio of the first compression chamber V1 can be increased close to a pressure ratio of the second compression chamber V2. The first compression chamber V1 is a compression chamber formed between an inner surface of the fixed wrap 144 and an outer surface of the orbiting wrap 152, and will be described later separately from the second compression chamber V2.

An arcuate compression surface 153*c* having an arcuate shape may be provided at another side of the concave portion 153*a*. The diameter of the arcuate compression surface 153*c* may be determined by a thickness of the inner end portion of the fixed wrap 144 (i.e., a thickness of a discharge end) and an orbiting radius of the orbiting wrap 152.

For example, when the thickness of the inner end portion of the fixed wrap 144 increases, the diameter of the arcuate compression surface 153*c* may increase. As a result, a wrap thickness of the orbiting wrap around the arcuate compression surface 153*c* may increase to ensure durability and thus the compression path may extend to increase the compression ratio of the second compression chamber V2 to that extent.

The protruding portion 144*a* protruding toward the outer circumferential surface of the rotating shaft coupling portion 153 may be formed near the inner end portion (suction end or start end) of the fixed wrap 144 corresponding to the rotating shaft coupling portion 153. Accordingly, a contact portion 144*b* may protrude from the protruding portion 144*a* to be engaged with the concave portion 153*a*.

In other words, the inner end portion of the fixed wrap 144 may be formed to have a larger thickness than other portions. As a result, wrap strength at the inner end portion of the fixed wrap 144, which is subjected to the strongest compressive force on the fixed wrap 144, may increase so as to enhance durability.

On the other hand, referring to FIG. 4, the compression chamber V may be formed in a space defined by the fixed end plate 141, the fixed wrap 144, the orbiting end plate 151, and the orbiting wrap 152. The compression chamber V may include a first compression chamber V1 formed between an inner surface of the fixed wrap 144 and an outer surface of the orbiting wrap 152, and a second compression chamber V2 formed between an outer surface of the fixed wrap 144 and an inner surface of the orbiting wrap 152.

In each of the first compression chamber V1 and the second compression chamber V2, a suction chamber Vs, an intermediate pressure chamber Vm, and a discharge chamber Vd may be continuously formed from outside to inside along an advancing direction of the wraps.

Here, the intermediate pressure chamber Vm and the discharge chamber Vd may be independently formed for each of the first compression chamber V1 and the second compression chamber V2. Accordingly, the first discharge port 141*a* may communicate with a discharge chamber Vd1 of the first compression chamber V1 and the second discharge port 141*b* may communicate with a discharge chamber Vd2 of the second compression chamber V2.

On the other hand, the suction chamber Vs may be formed to be shared by the first compression chamber V1 and the second compression chamber V2. That is, the suction chamber Vs may be formed at an outer side than the orbiting wrap 152 based on the advancing direction of the wrap. Specifically, the suction chamber Vs may be defined as a space formed in an area that the end of the orbiting wrap 152 does not reach, namely, outside an orbiting range of the orbiting wrap 152, in a space formed between the inner circumferential surface of the fixed side wall portion 142 and an outer surface of the outermost fixed wrap 144 extending from the fixed side wall portion 142.

Accordingly, the second suction passage 1921 may be formed through the fixed end plate 141 in the axial direction to communicate with the suction chamber Vs, and the suction passage opening and closing valve 195 may not interfere with the orbiting wrap 152 even though it passes through the suction chamber Vs while moving in the second suction passage 1921 in the axial direction along the fixed side wall portion 142. This will be described later again together with the suction passage and the suction passage opening and closing valve.

On the other hand, an eccentric portion bearing 173 configured as a bush bearing may be fitted onto the inner circumferential surface of the rotating shaft coupling portion 153. The eccentric portion 1254 of the rotating shaft 125 may be rotatably inserted into the eccentric portion bearing 173. Accordingly, the eccentric portion 1254 of the rotating shaft 125 may be supported by the eccentric portion bearing 173 in the radial direction so as to perform a smooth orbiting motion with respect to the orbiting scroll 150.

Here, the oil accommodating portion 155 may be formed inside the rotating shaft coupling portion 153. The oil accommodating portion 155 may communicate with the compression chamber oil supply hole 156 that is formed through the orbiting end plate 151 in the radial direction.

The oil accommodating portion 155 may formed on the upper side of the eccentric portion bearing 173. For example, an axial length of the eccentric portion bearing 173 may be shorter than an axial length (height) of the rotating shaft coupling portion 153. Accordingly, a space corresponding to a difference in length between the eccentric portion bearing 173 and the rotating shaft coupling portion 153 and the thickness of the eccentric portion bearing 173 may be formed in an upper end of the eccentric portion bearing 173. This space may communicate with the third oil hole 1262*c* or the first oil hole 1262*a* of the rotating shaft 125 to define the aforementioned oil accommodating portion 155.

Alternatively, only one compression chamber oil supply hole 156 may be provided to communicate with any one of the first compression chamber V1 and the second compression chamber V2. However, in the illustrated implementation, the compression chamber oil supply hole 156 may include a first compression chamber oil supply hole 1561 communicating with the first compression chamber V1, and a second compression chamber oil supply hole 1562 communicating with the second compression chamber V2.

For example, one end, namely, an inlet of the first compression chamber oil supply hole 1561 and one end, namely, an inlet of the second compression chamber oil supply hole 1562 may communicate with the oil accommodating portion 155, respectively, and another end, namely, an outlet of the first compression chamber oil supply hole 1561 and another end, namely, an outlet of the second compression chamber oil supply hole 1562 may communicate with the first compression chamber V1 and the second compression chamber V2, respectively.

Specifically, the outlets of the first compression chamber oil supply hole 1561 and the second compression chamber oil supply hole 1562 may penetrate through the lower surface of the orbiting end plate 151 at a time point when suction in each compression chamber V1 and V2 is completed, namely, at a rotating angle of the orbiting wrap 152 greater than a rotating angle of the orbiting wrap 152, at which the suction in each compression chamber V1 and V2 is completed.

Accordingly, the outlets of the first compression chamber oil supply hole 1561 and the second compression chamber oil supply hole 1562 may be located at a downstream side more than the suction passage opening and closing valve 195 based on a direction that the refrigerant is sucked. Accordingly, when the compressor is stopped, oil which is intended to flow back toward the refrigerant suction pipe 115 through the first compression chamber oil supply hole 1561 and the second compression chamber oil supply hole 1562 may be blocked by the suction passage opening and closing valve 195, thereby preventing oil leakage from the compression chambers V1 and V2 toward the refrigerant suction pipe 115.

Hereinafter, the discharge cover will be described.

Referring back to FIGS. 5 to 7, the discharge cover 160 may include a cover housing portion 161 and a cover flange portion 162. The cover housing portion 161 may have a cover space 161*a* therein defining the discharge space S4 together with the fixed scroll 140.

The cover housing portion 161 may include a housing bottom surface 1611 and a housing side wall surface 1612 extending in the axial direction from the housing bottom surface 1611 to have a substantially annular shape.

Accordingly, the housing bottom surface 1611 and the housing side wall surface 1612 may define the cover space 161*a* for accommodating the outlets of the discharge ports 141*a* and 141*b* provided in the fixed scroll 140 and the inlet of the first discharge hole 142*a*, and the cover space 161*a* may define the discharge space S4 together with a surface of the fixed scroll 140 inserted into the cover space 161*a*.

A cover bearing protrusion 1613 may protrude from a central portion of the housing bottom surface 1611 toward the fixed scroll 140 in the axial direction, and a through hole 1613*a* may be formed through the inside of the cover bearing protrusion 1613 in the axial direction.

The sub bearing portion 143 that protrudes from the rear surface of the fixed scroll 140, namely, the fixed end plate 141 in a downward direction (axial direction) may be inserted into the through hole 1613*a*. A cover sealing member 1614 for sealing a gap between an inner circumferential surface of the through hole 1613*a* and an outer circumferential surface of the sub bearing portion 143 may be inserted into the gap.

The housing side wall surface 1612 may extend outward from an outer circumferential surface of the cover housing portion 161 so as to be coupled in close contact with the lower surface of the fixed scroll 140. In addition, at least one discharge guide groove 1612*a* may be formed on an inner circumferential surface of the housing side wall surface 1612 along the circumferential direction.

The discharge guide groove 1612*a* may be recessed outward in the radial direction, and the first discharge hole 142*a* of the fixed scroll 140 defining a first refrigerant discharge passage may be formed to be positioned inside the discharge guide groove 1612*a*. Accordingly, an inner surface of the housing side wall surface 1612 excluding the discharge guide groove 1612*a* may be brought into close contact with the outer circumferential surface of the fixed scroll 140, namely, the outer circumferential surface of the fixed end plate 141 so as to configure a type of sealing part.

Here, an entire circumferential angle of the discharge guide groove 1612*a* may be formed to be smaller than or equal to an entire circumferential angle with respect to an inner circumferential surface of the discharge space S4 except for the discharge guide groove 1612*a*. In this manner, the inner circumferential surface of the discharge space S4 except for the discharge guide groove 1612*a* can secure not only a sufficient sealing area but also a circumferential length for forming the cover flange portion 162 to be described later.

The housing side wall surface 1612 may be provided with oil recovery grooves 1612*b* formed on an outer circumferential surface thereof with a preset interval along the circumferential direction so as to define a third oil recovery groove. For example, the oil recovery groove 1612*b* may be formed on the outer circumferential surface of the housing side wall surface 1612. The oil recovery groove 1612*b* may define the third oil recovery groove together with oil recovery grooves 162*b* of the cover flange portion 162 to be described later. The third oil recovery groove of the discharge cover 160 may define the second oil recovery passage together with the first oil recovery groove of the main frame 130 and the second oil recovery groove of the fixed scroll 140.

The cover flange portion 162 may extend radially from a portion defining the sealing part, namely, from an outer circumferential surface of a portion, excluding the discharge guide groove 1612*a*, of the housing side wall surface 1612 of the cover housing portion 161.

The cover flange portion 162 may be provided with coupling holes 162*a* for coupling the discharge cover 160 to the fixed scroll 140 with bolts, and a plurality of oil recovery grooves 162*b* formed between the neighboring coupling holes 162*a* at preset intervals in the circumferential direction.

The oil recovery grooves 162*b* formed on the cover flange portion 162 may define the third oil recovery groove together with the oil recovery groove 1612*b* formed on the housing side wall surface 1612. The oil recovery grooves 162*b* formed on the cover flange portion 162 may be recessed inward (toward a center) in the radial direction from an outer circumferential surface of the cover flange portion 162.

Meanwhile, the first suction passage 1912 may be formed in the discharge cover 160, and the refrigerant suction pipe 115 may communicate with the second suction passage 1921 of the fixed scroll 140 through the first suction passage 1912. The refrigerant suction pipe 115 inserted through the cylindrical shell 111 may be inserted into an inlet of the first suction passage 1912 so as to communicate directly with the first suction passage 1912. An outlet of the first suction passage 1912 may communicate with the second suction passage 1921 of the fixed scroll 140. In addition, the outlet of the first suction passage 1912 may be selectively opened and closed by the suction passage opening and closing valve 195 inserted into the second suction passage 1921.

Accordingly, refrigerant circulating in the refrigeration cycle during the operation of the compressor may flow into the first suction passage 1912 of the discharge cover 160 through the refrigerant suction pipe 115. The refrigerant may open the suction passage opening and closing valve 195 so as to be introduced into the suction chamber Vs through the second suction passage 1921.

In the drawings, unexplained reference numeral 21 denotes a condenser fan, 41 denotes an evaporator fan, and 1911 denotes a suction guide protrusion.

Hereinafter, an operation of the high-pressure and bottom-compression type scroll compressor according to the implementation will be described.

That is, when power is applied to the motor unit 120, rotational force may be generated and the rotor 22 and the rotating shaft 125 may rotate accordingly. As the rotating shaft 125 rotates, the orbiting scroll 35 eccentrically coupled to the rotating shaft 125 may perform an orbiting motion by the Oldham ring 180.

Accordingly, the volume of the compression chamber V may gradually decrease from a suction chamber Vs formed at an outer side of the compression chamber V toward an intermediate pressure chamber Vm continuously formed toward a center and a discharge chamber Vd in a central portion.

Then, refrigerant may move to the accumulator 50 sequentially via the condenser 20, the expansion apparatus 30, and the evaporator 40 of the refrigeration cycle. The refrigerant may flow toward the suction chamber Vs forming the compression chamber V through the refrigerant suction pipe 115.

The refrigerant sucked into the suction chamber Vs may be compressed while moving to the discharge chamber Vd via the intermediate pressure chamber Vm along a movement trajectory of the compression chamber V. The compressed refrigerant may be discharged from the discharge chamber Vd to the discharge space S4 of the discharge cover 60 through the discharge ports 141*a* and 141*b*.

The refrigerant discharged into the discharge space S4 of the discharge cover 160 may then flow into the inner space 110*a* of the casing 110 through the discharge guide groove 1612*a* of the discharge cover 160 and the first discharge holes 142*a* of the fixed scroll 140. The refrigerant may flow to the lower space S1 between the main frame 130 and the driving motor 120 and then move toward the upper space S2 of the casing 110, which is defined above the driving motor 120, through a gap between the stator 121 and the rotor 122.

However, oil may be separated from the refrigerant in the upper space S2 of the casing 110, and the oil-separated refrigerant may be discharged to the outside of the casing 110 through the refrigerant discharge pipe 116 so as to flow to the condenser 20 of the refrigeration cycle.

On the other hand, the oil separated from the refrigerant in the inner space 110*a* of the casing 110 may be recovered into the oil storage space S3 defined in the lower portion of the compression unit through the first oil recovery passage between the inner circumferential surface of the casing 110 and the stator 121 and the second oil recovery passage between the inner circumferential surface of the casing 110 and the outer circumferential surface of the compression unit. This oil may thusly be supplied to each bearing surface (not shown) through the oil supply passage 126, and partially supplied into the compression chamber V. The oil supplied to the bearing surface and the compression chamber V may be discharged to the discharge cover 160 together with the refrigerant and recovered. This series of processes may be repeatedly performed.

On the other hand, when the compressor 10 is stopped, the refrigeration cycle including the compressor 10 may perform an operation to enter a so-called pressure equilibrium state. At this time, the oil or refrigerant filled in the inner space 110*a* of the casing 110 may flow back toward the refrigerant suction pipe 115. Due to the back flow of the oil or refrigerant, a specific volume of suction refrigerant may be increased and suction loss may be increased thereby. Also, upon restart of a refrigeration cycle, an oil shortage may be caused, thereby lowering reliability and performance of the compressor.

However, the back flow of the oil or refrigerant may be suppressed by a suction passage opening and closing valve 195 that is installed in the middle of the suction passage 190, for example, in the middle between the first suction passage 1912 and the second suction passage 1921 so as to configure a kind of check valve. The suction passage opening and closing valve 195 may block the suction passage 190 when the compressor is stopped, thereby preventing the oil or refrigerant in the casing 110 from flowing back toward the suction passage 190 through the compression unit.

In this way, in the scroll compressor of the high-pressure type and the bottom-compression type, as the suction passage opening and closing valve is installed between an outlet of the refrigerant suction pipe and an inlet of the compression unit, the oil or refrigerant in the casing can be quickly prevented from flowing back to the refrigerant suction pipe through the compression unit when the compressor is stopped. Accordingly, upon the restart of the compressor, an increase in a specific volume of the refrigerant can be suppressed and friction loss due to a shortage of oil can be reduced, thereby improving compression efficiency.

As the suction passage opening and closing valve is operated in the axial direction, the structure of the suction passage opening and closing valve can be simplified, which may result in reducing a fabricating cost and simultaneously improving responsiveness of the valve, thereby enhancing the compression efficiency.

In addition, as the suction passage is formed in the discharge cover or the fixed scroll, the suction passage may be formed in an oil storage space located below the compression unit, so that the compressor can be reduced in size while maintaining its axial length.

On the other hand, as described above, when different oil supply paths (for example, a first oil supply hole and a second oil supply hole) are formed to communicate individually with the first and second compression chambers, at least one of the different oil supply paths may be opened toward the corresponding compression chamber.

In particular, oil supply sections (e.g., a first oil supply section in which the first oil supply hole is open and a second oil supply section in which the second oil supply hole is open) in which the different oil supply paths are open to the corresponding compression chambers may be formed to overlap each other within a preset crank angle range.

In other words, oil supply sections (e.g., first and second oil supply sections) in which the respective oil supply paths are open may have an overlap section. Then, even if the orbiting scroll performs the orbiting motion during the operation of the compressor, at least one oil supply path may be open, such that oil can be fed to the compression unit without interruption, thereby suppressing friction loss.

However, if the first oil supply section and the second oil supply section overlap each other within a preset crank angle range, it may be advantageous in terms of oil supply, but may be disadvantageous in terms of compression efficiency. For example, when a pressure difference between the first compression chamber and the second compression chamber occurs, a phenomenon in which refrigerant compressed in a high-pressure side partially flows back to a low pressure-side may occur in the section where the first oil supply section and the second oil supply section overlap each other. As a result, compression loss may be increased and compression efficiency may be decreased.

Therefore, in the implementation of the present disclosure, a first compression chamber oil supply hole communicating with a first compression chamber and a second compression chamber oil supply hole communicating with the second compression chamber may be individually provided, so as to prevent both the compression chambers from communicating with each other through the first compression chamber oil supply hole and the second compression chamber oil supply hole.

Figure 8:
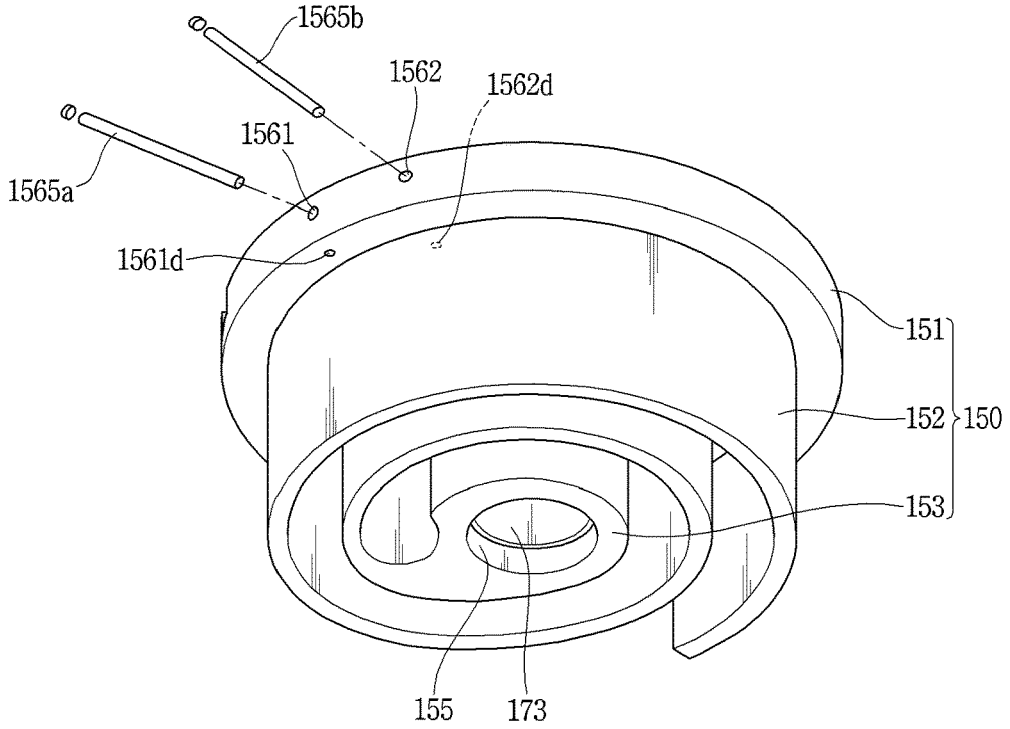
FIG. 8 is a perspective view of an orbiting scroll in accordance with an implementation of the present disclosure.
Figure 9:
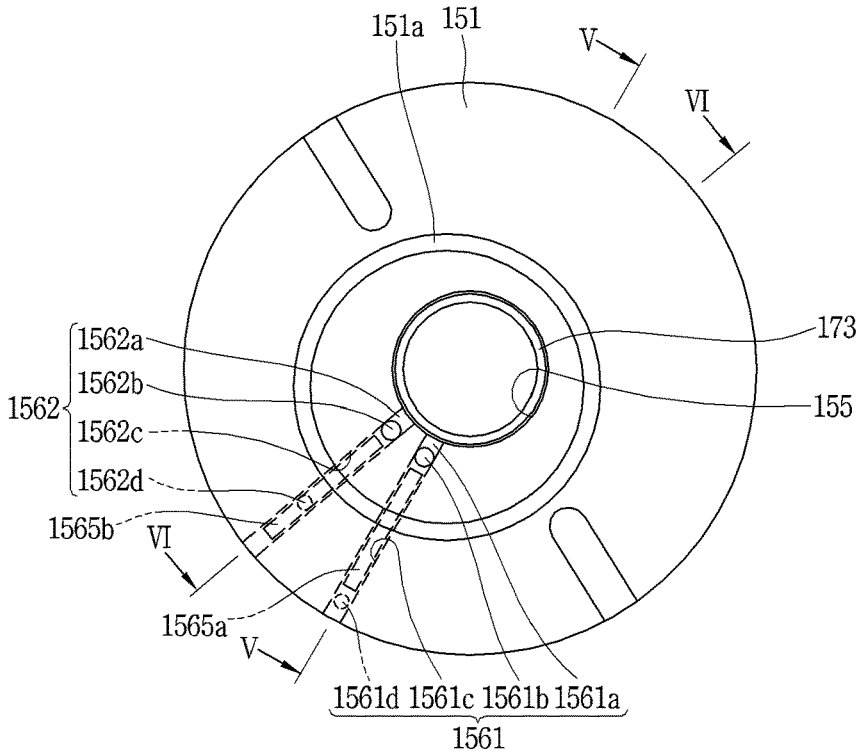
FIG. 9 is a planar view of the orbiting scroll according to FIG. 8, viewed from the top.
Figure 10:
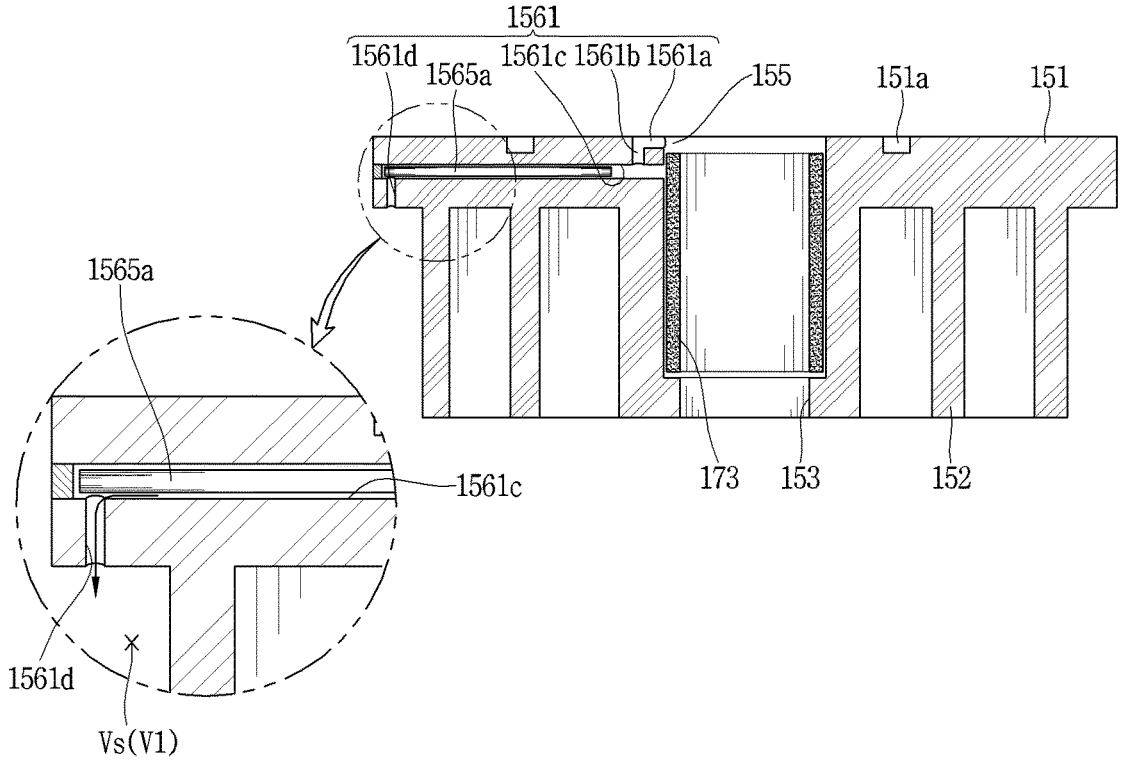
FIG. 10 is a sectional view taken along the line "V-V" in FIG. 9, which illustrates a first compression chamber oil supply hole of the orbiting scroll.
Figure 11:
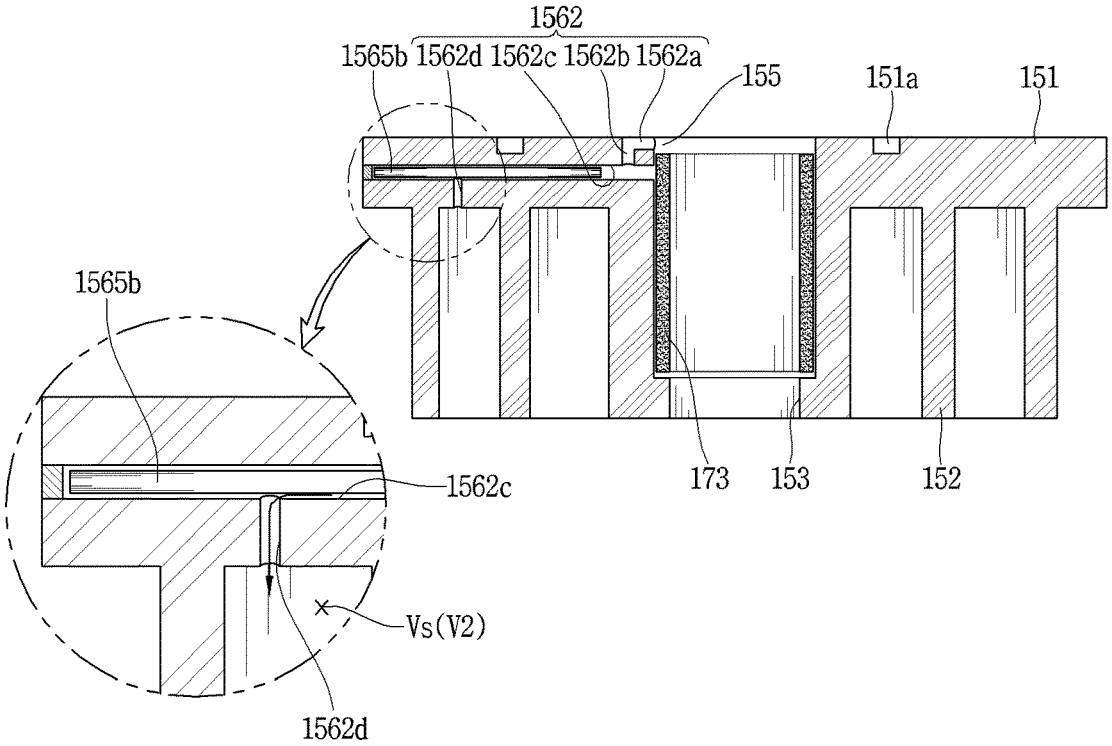
FIG. 11 is a sectional view taken along the line "VI-VI" in FIG. 9, which illustrates a second compression chamber oil supply hole of the orbiting scroll.

FIG. 8 is a perspective view of an orbiting scroll in accordance with an implementation of the present disclosure, FIG. 9 is a planar view of the orbiting scroll according to FIG. 8, viewed from the top, FIG. 10 is a sectional view taken along the line "V-V" in FIG. 9, which illustrates a first compression chamber oil supply hole of the orbiting scroll, and FIG. 11 is a sectional view taken along the line "VI-VI" in FIG. 9, which illustrates a second compression chamber oil supply hole of the orbiting scroll.

Referring to FIGS. 8 and 9, a first compression chamber oil supply hole 1561 and a second compression chamber oil supply hole 1562 according to an implementation may be formed in the orbiting end plate 151.

For example, the first compression chamber oil supply hole 1561 and the second compression chamber oil supply hole 1562 may penetrate through the inside of the orbiting end plate 151 in the radial direction from an inner circumferential surface of the rotating shaft coupling portion 153, and then penetrate through a side surface of the orbiting end plate 151 facing the fixed end plate 141. Accordingly, the first compression chamber oil supply hole 1561 and the second compression chamber oil supply hole 1562 may allow the oil accommodating portion 155, which is provided in the rotating shaft coupling portion 153, more precisely, the upper end of the eccentric portion bearing 173, to communicate with the first compression chamber V1 and the second compression chamber V2, respectively.

The first compression chamber oil supply hole 1561 and the second compression chamber oil supply hole 1562 may have the same basic configuration, except for positions where outlets of those oil supply holes communicate with the first compression chamber V1 and the second compression chamber V2, respectively. Hereinafter, the first compression chamber oil supply hole 1561 and the second compression chamber oil supply hole 1562 will be described sequentially.

Referring to FIGS. 9 and 10, the first compression chamber oil supply hole 1561 may include a first oil supply inlet portion 1561*a*, a first oil supply connection portion 1561*b*, a first oil supply penetration portion 1561*c*, and a first oil supply outlet portion 1561*d*. Accordingly, oil inside the oil accommodating portion 155 may be supplied to the first compression chamber V1 sequentially via the first oil supply inlet portion 1561*a*, the first oil supply connection portion 1561*b*, the first oil supply penetration portion 1561*c*, and the first oil supply outlet portion 1561*d*.

The first oil supply inlet portion 1561*a* may have an inlet end communicating with an inner circumferential surface of the oil accommodating portion 155 to define an inlet of the first compression chamber oil supply hole 1561. For example, the first oil supply inlet portion 1561*a* may be recessed into the upper surface of the orbiting end plate 151 by a preset depth and extend in the radial direction. Accordingly, oil contained in the oil accommodating portion 155 may move to the first oil supply inlet portion 1561*a* and spread to the upper surface of the orbiting scroll 150 at an inner space (e.g., back pressure chamber) of the back pressure sealing member 1515, thereby smoothly lubricating a gap between the main frame 130 and the orbiting scroll 150.

The first oil supply inlet portion 1561*a* may extend in a direction in which the back pressure sealing groove 151*a* is eccentric from the rotating shaft coupling portion 153 at an inner side than the back pressure sealing grove 151*a*. However, considering the fact that a first pressure reducing member 1565*a* is installed inside the first oil supply penetration portion 1561*c*, a length of the first oil supply inlet portion 1561*a* may preferably be as short as possible.

The first oil supply connection portion 1561*b* may extend in the axial direction from an end of the first oil supply inlet portion 1561*a* and be recessed by an intermediate depth of the orbiting end plate 151. Accordingly, oil flowing into the first oil supply inlet portion 1561*a* may move toward the first oil supply penetration portion 1561*c* through the first oil supply connection portion 1561*b*.

The first oil supply penetration portion 1561*c* may be formed through the inside of the orbiting end plate 151 in the radial direction. Since the first oil supply penetration portion 1561*c* may be made in a direction from an outer circumferential surface to an inner circumferential surface of the orbiting end plate 151, a blocking bolt (not shown) may be coupled to an outer end of the first oil supply penetration portion 1561*c*, so as to seal the outer end of the first oil supply penetration portion 1561*c*.

The first pressure reducing member 1565*a* may be inserted into the oil supply penetration portion 1561*c*. The first pressure reducing member 1565*a* may be configured as a pressure reducing pin having an outer diameter smaller than an inner diameter of the first oil supply penetration portion 1561*c*. Accordingly, oil in the oil accommodating portion 155 may be decompressed while passing through the first pressure reducing member 1565*a* inside the oil supply penetration portion 1561*c* and then supplied to the first compression chamber V1.

The first oil supply outlet portion 1561*d* may penetrate through the lower surface of the orbiting end plate 151 at an end portion of the first oil supply penetration portion 1561*c* in the radial direction. Accordingly, the first compression chamber oil supply hole 1561 may allow the communication between the oil accommodating portion 155 and the first compression chamber V1.

The first oil supply outlet portion 1561*d* may be formed at a position spaced apart from an outer circumferential surface of the outermost orbiting wrap 152 by a preset interval. As described above, the first oil supply outlet portion 1561*d* may penetrate through a surface facing the fixed end plate 141, namely, the lower surface of the orbiting end plate 151, at the outer end portion of the first oil supply penetration portion 1561*c*. The first oil supply outlet portion 1561*d* may have an inner diameter which is smaller than or equal to an inner diameter of the first oil supply penetration portion 1561*c*, for example, smaller than a wrap thickness of the fixed wrap 144.

On the other hand, the second compression chamber oil supply hole 1562 may be formed almost similar to the first compression chamber oil supply hole 1561.

Referring to FIGS. 9 and 11, the second compression chamber oil supply hole 1562 may include a second oil supply inlet portion 1562*a*, a second oil supply connection portion 1562*b*, a second oil supply penetration portion 1562*c*, and a second oil supply outlet portion 1562*d*. Accordingly, oil inside the oil accommodating portion 155 may be supplied to the second compression chamber V2 sequentially via the second oil supply inlet portion 1562*a*, the second oil supply connection portion 1562*b*, the second oil supply penetration portion 1562*c*, and the second oil supply outlet portion 1562*d*.

The second oil supply inlet portion 1562*a* may have an inlet end communicating with an inner circumferential surface of the oil accommodating portion 155 to define an inlet of the second compression chamber oil supply hole 1562. For example, the second oil supply inlet portion 1562*a* may be recessed into the upper surface of the orbiting end plate 151 by a preset depth and extend in the radial direction. Accordingly, oil contained in the oil accommodating portion 155 may move to the second oil supply inlet portion 1562*a* and spread to the upper surface of the orbiting scroll 150 at an inner space (e.g., back pressure chamber) of the back pressure sealing member 1515, thereby smoothly lubricating a gap between the main frame 130 and the orbiting scroll 150.

The second oil supply inlet portion 1562*a* may extend in a direction in which the back pressure sealing groove 151*a* is eccentric from the rotating shaft coupling portion 153 at an inner side than the back pressure sealing grove 151*a*. However, considering the fact that a second pressure reducing member 1565*a* is installed inside the second oil supply penetration portion 1562*c*, a length of the second oil supply inlet portion 1562*a* may preferably be as short as possible.

The second oil supply connection portion 1562*b* may extend in the axial direction from an end of the second oil supply inlet portion 1562*a* and be recessed by an intermediate depth of the orbiting end plate 151. Accordingly, oil flowing into the second oil supply inlet portion 1562*a* may move toward the first oil supply penetration portion 1562*c* through the second oil supply connection portion 1561*b*.

The second oil supply penetration portion 1562*c* may be formed through the inside of the orbiting end plate 151 in the radial direction. Since the second oil supply penetration portion 1562*c* may be made in a direction from an outer circumferential surface to an inner circumferential surface of the orbiting end plate 151, a blocking bolt (not shown) may be coupled to an outer end of the second oil supply penetration portion 1562*c*, so as to seal the outer end of the second oil supply penetration portion 1562*c*.

The second pressure reducing member 1565*a* may be inserted into the second oil supply penetration portion 1562*c*. The second pressure reducing member 1565*a* may be configured as a pressure reducing pin having an outer diameter smaller than an inner diameter of the second oil supply penetration portion 1562*c*. Accordingly, oil in the oil accommodating portion 155 may be decompressed while passing through the second pressure reducing member 1565*a* inside the second oil supply penetration portion 1562*c* and then supplied to the second compression chamber V2.

The second oil supply outlet portion 1562*d* may penetrate through the lower surface of the orbiting end plate 151 at an end portion of the second oil supply penetration portion 1562*c* in the radial direction. Accordingly, the second compression chamber oil supply hole 1562 may allow the communication between the oil accommodating portion 155 and the second compression chamber V2.

The second oil supply outlet portion 1562*d* may be formed at a position spaced apart from an inner circumferential surface of the outermost orbiting wrap 152 by a preset interval. As described above, the second oil supply outlet portion 1562*d* may penetrate through a surface facing the fixed end plate 141, namely, the lower surface of the orbiting end plate 151, near the outer end of the first oil supply penetration portion 1562*c*. The second oil supply outlet portion 1562*d* may have an inner diameter which is smaller than or equal to an inner diameter of the second oil supply penetration portion 1562*c*, for example, smaller than a wrap thickness of the fixed wrap 144.

On the other hand, the first oil supply outlet portion 1561*d* forming the outlet of the first compression chamber oil supply hole 1561 may be formed at a position where it communicates with the first compression chamber V1, regardless of an orbiting position (crank angle) of the orbiting scroll 150, and the second oil supply outlet portion 1562*d* forming the outlet of the second compression chamber oil supply hole 1562 may be formed at a position where it communicates with the second compression chamber V2, regardless of the orbiting position (crank angle) of the orbiting scroll 150.

Figure 12:
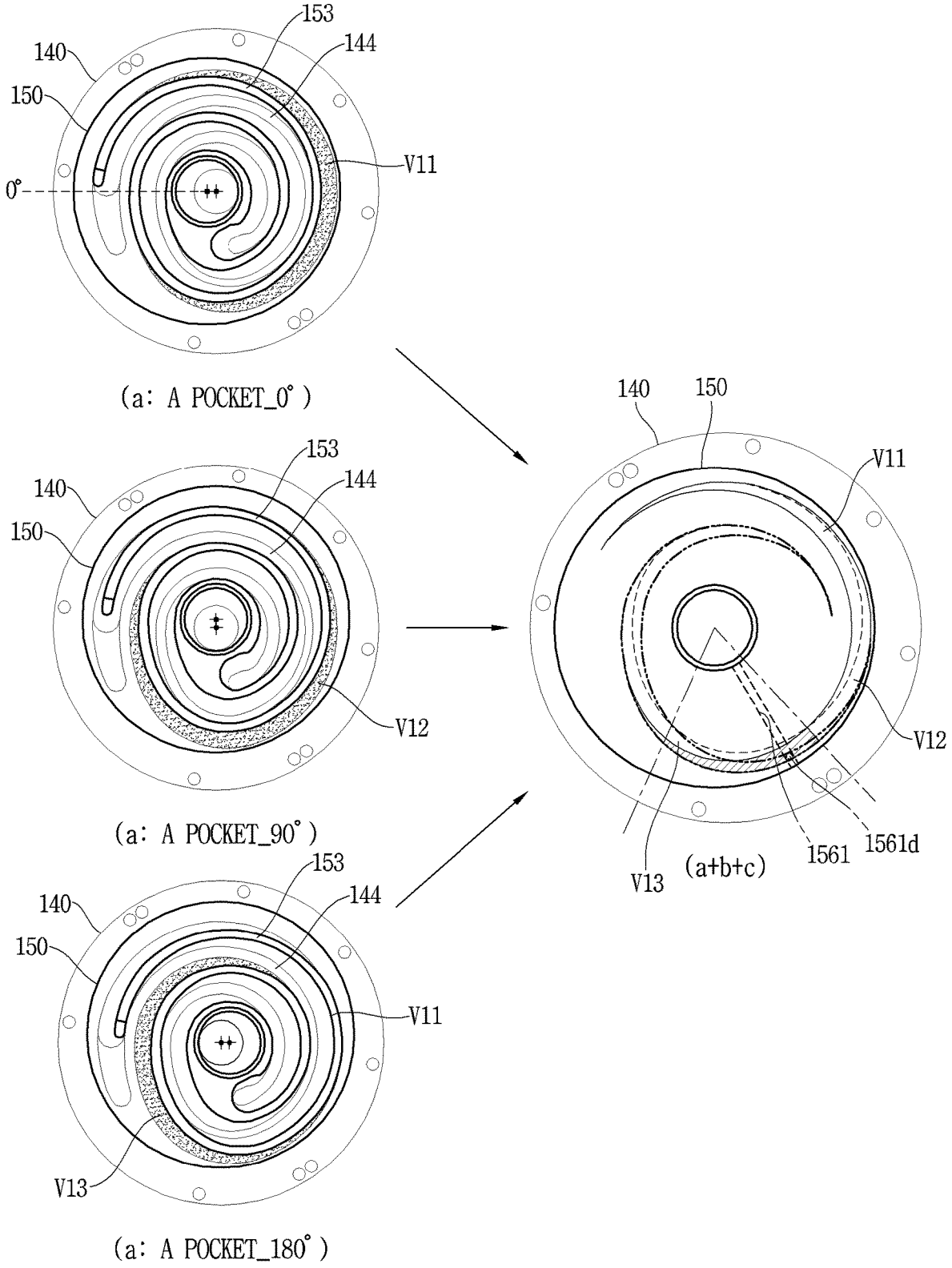
FIG. 12 is a planar view illustrating an appropriate position of an outlet of the first compression chamber oil supply hole in FIG. 8.

FIG. 12 is a planar view illustrating an appropriate position of an outlet of the first compression chamber oil supply hole in FIG. 8. (a) of FIG. 12 illustrates the position of the first compression chamber (pocket A) when the crank angle is 0°, and (b) of FIG. 12 illustrates the position of the first compression chamber (pocket A) when the crank angle is 90°. Also, (c) of FIG. 12 illustrates the position of the first compression chamber (pocket A) when the crank angle is 180°. In addition, (a+b+c) of FIG. 12 illustrates a portion where the positions of the first compression chamber (pocket A) in (a), (b), and (c) of FIG. 12 overlap. Hereinafter, an angle is a crank angle unless otherwise specified.

Referring to (a) of FIG. 12, the first compression chamber (pocket A) V1 may be shown at a time point when a compression stroke starts just after completion of a suction stroke. In this case, the first compression chamber (pocket A) V1 may be formed in a crank angle range of approximately 0° to 330°. Therefore, considering only (a) of FIG. 12, it may be appropriate that the outlet (first oil supply outlet portion) 1561*d* of the first compression chamber oil supply hole 1561 is located within the crank angle range V11 of approximately 0° to 330°.

Referring to (b) of FIG. 12, the first compression chamber (pocket A) V1 may be shown at a time point when the compression stroke is in progress after moving along an orbiting trajectory of the orbiting scroll 150. In this case, the first compression chamber (pocket A) V1 may be formed in a crank angle range of approximately 90° to 420°. Therefore, considering only (b) of FIG. 12, it may be appropriate that the outlet (first oil supply outlet portion) 1561*d* of the first compression chamber oil supply hole 1561 is located within the crank angle range V12 of approximately 90° to 420°.

Referring to (c) of FIG. 12, the first compression chamber (pocket A) V1 may be shown at a time point when the compression stroke is further in progress after moving along the orbiting trajectory of the orbiting scroll 150. In this case, the first compression chamber (pocket A) V1 may be formed in a crank angle range of approximately 180° to 510°. Therefore, considering only (c) of FIG. 12, it may be appropriate that the outlet (first oil supply outlet portion) 1561*d* of the first compression chamber oil supply hole 1561 is located within the crank angle range V13 of approximately 180° to 510°.

However, when only one first compression chamber oil supply hole 1561 is formed in the first compression chamber V1, the first compression chamber oil supply hole 1561 may preferably be formed to be included in the range of the first compression chamber V1 at each crank angle exemplarily illustrated above. Accordingly, when viewing (a+b+c) of FIG. 12, the first oil supply outlet portion 1561*d* as the outlet of the first compression chamber oil supply hole 1561 may be formed in a section included in all cases where the crank angle is 0°, 90°, and 180°, that is, in a crank angle range V11+V12+V13 in which regions of the first compression chamber at the respective crank angles overlap together.

Accordingly, the first oil supply outlet portion 1561*d* according to the implementation may be formed within a crank angle range of approximately 180° to 330°. However, considering the inner diameter of the first oil supply outlet portion 1561*d*, the first oil supply outlet portion 1561*d* may preferably be formed within a crank angle range of approximately 220° to 290°.

Figure 13:
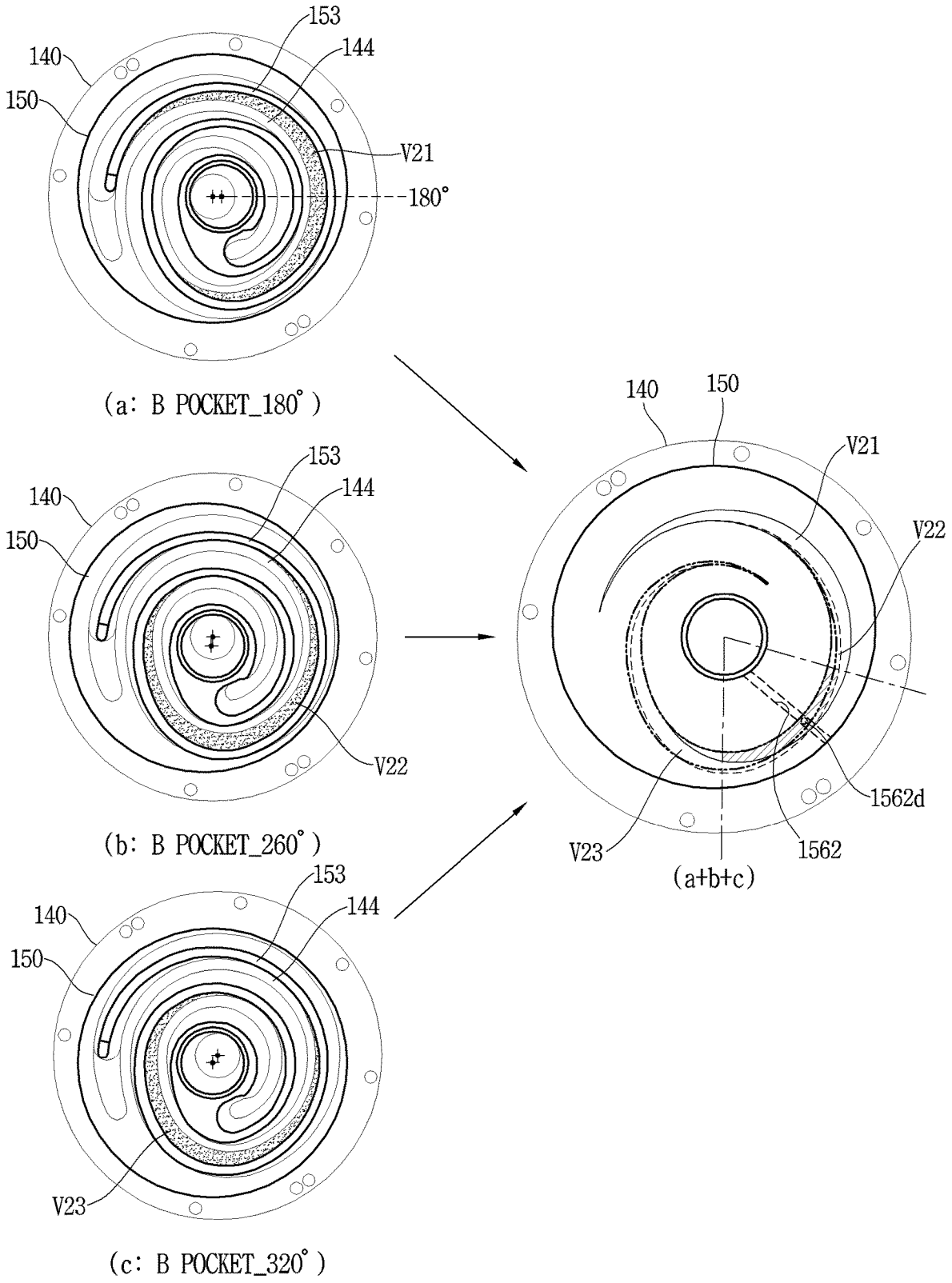
FIG. 13 is a planar view illustrating an appropriate position of an outlet of the second compression chamber oil supply hole in FIG. 8.

On the other hand, FIG. 13 is a planar view illustrating an appropriate position of an outlet of the second compression chamber oil supply hole in FIG. 8. (a) of FIG. 13 illustrates the position of the second compression chamber (pocket B) when the crank angle is 180°, and (b) of FIG. 13 illustrates the position of the second compression chamber (pocket B) when the crank angle is 260°. Also, (c) of FIG. 13 illustrates the position of the second compression chamber (pocket B) when the crank angle is 320°. In addition, (a+b+c) of FIG. 13 illustrates a portion where the positions of the second compression chamber (pocket B) in (a), (b), and (c) of FIG. 13 overlap. Hereinafter, an angle is also the crank angle unless otherwise specified.

Referring to (a) of FIG. 13, the second compression chamber (pocket B) V2 may be shown at a time point when a compression stroke starts just after completion of a suction stroke. In this case, the second compression chamber (pocket B) V2 may be formed in a crank angle range V21 of approximately −10° to 320°. Therefore, considering only (a) of FIG. 13, it may be appropriate that the outlet (second oil supply outlet portion) 1562*d* of the second compression chamber oil supply hole 1562 is located within the crank angle range of approximately −10° to 320°.

Referring to (b) of FIG. 13, the second compression chamber (pocket B) V2 may be shown at a time point when the compression stroke is in progress after moving along an orbiting trajectory of the orbiting scroll 150. In this case, the second compression chamber (pocket B) V2 may be formed in a crank angle range of approximately 80° to 40°. Therefore, considering only (b) of FIG. 13, it may be appropriate that the outlet (second oil supply outlet portion) 1562*d* of the second compression chamber oil supply hole 1562 is located within the crank angle range of approximately 80° to 400°.

Referring to (c) of FIG. 13, the second compression chamber (pocket B) V2 may be shown at a time point when the compression stroke is further in progress after moving along the orbiting trajectory of the orbiting scroll 150. In this case, the second compression chamber (pocket B) V2 may be formed in a crank angle range V23 of approximately 170° to 490°. Therefore, considering only (c) of FIG. 13, it may be appropriate that the outlet (second oil supply outlet portion) 1562*d* of the second compression chamber oil supply hole 1562 is located within the crank angle range of approximately 170° to 490°.

However, when only one second compression chamber oil supply hole 1562 is formed in the second compression chamber V2, the second compression chamber oil supply hole 1562 may preferably be formed to be included in the range of the compression chamber at each crank angle exemplarily illustrated above. Accordingly, when viewing (a+b+c) of FIG. 13, the second oil supply outlet portion 1562*d* as the outlet of the second compression chamber oil supply hole 1562 may be formed in a section included in all cases where the crank angle is 180°, 260°, and 320°, that is, in a crank angle range V21+V22+V23 in which regions of the second compression chamber at the respective crank angles overlap together.

Accordingly, the second oil supply outlet portion 1562*d* according to the implementation may be formed within a crank angle range of approximately 170° to 330°. However, considering the inner diameter of the second oil supply outlet portion 1562*d*, the second oil supply outlet portion 1562*d* may preferably be formed within a crank angle range of approximately 210° to 280°.

On the other hand, the position of the first oil supply outlet portion 1561*d* and the position of the second oil supply outlet portion 1562*d* may be linked to a design pressure ratio, respectively.

That is, when the design pressure ratio is 1.0 to 1.1 (first pressure ratio section), the first oil supply outlet portion 1561*d* may be formed in the range of 0° to 90°, and the second oil supply outlet portion 1562*d* may be formed in the range of 180° to 260°.

In addition, when the design pressure ratio is 1.1 to 1.2 (second pressure ratio section), the first oil supply outlet portion 1561*d* may be formed in the range of 90° to 180°, and the second oil supply outlet portion 1562*d* may be formed in the range of 260° to 320°.

In addition, when the design pressure ratio is 1.2 to 1.3 (third pressure ratio section), the first oil supply outlet portion 1561*d* may be formed in the range of 180° to 250° and the second oil supply outlet portion 1562*d* may be formed in the range of 320° to 380°.

On the other hand, the first oil supply outlet portion 1561*d* may be formed at a position where the first compression chamber oil supply hole 1561 communicates with the first compression chamber V1 and the second compression chamber oil supply hole 1562 communicates with the second compression chamber V2, independently, regardless of the orbiting position (crank angle) of the orbiting scroll 150.

Figure 14:
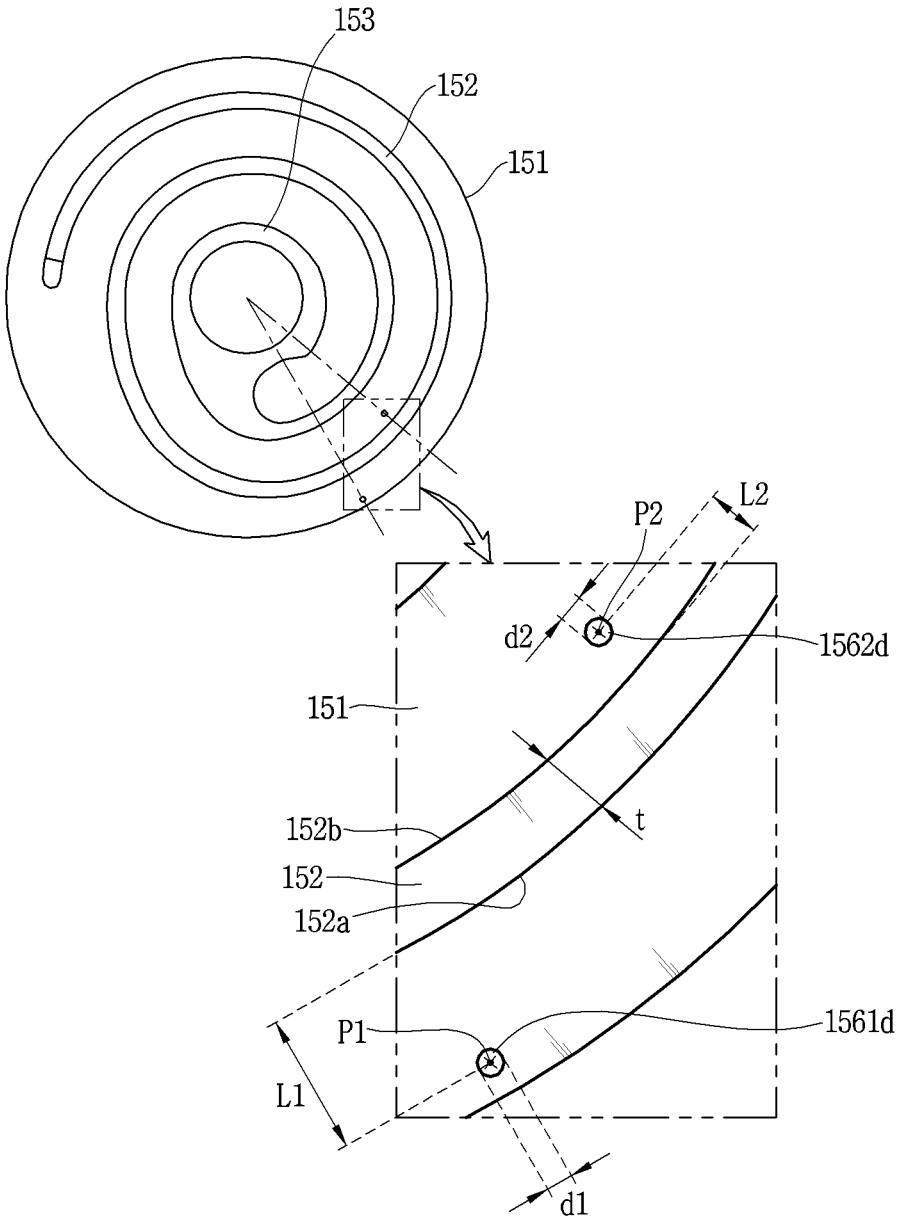
FIG. 14 is a planar view, when viewing the orbiting scroll from the bottom, for explaining appropriate spaced distances of the first compression chamber oil supply hole and the second compression chamber oil supply hole in FIG. 8 from an orbiting wrap.

FIG. 14 is a planar view, when viewing the orbiting scroll from the bottom, for explaining appropriate spaced distances of the first compression chamber oil supply hole and the second compression chamber oil supply hole in FIG. 8 from the orbiting wrap.

Referring to FIG. 14, the first oil supply outlet portion 1561*d* forming the outlet of the first compression chamber oil supply hole 1561 may be formed at a position spaced apart from the outer circumferential surface of the outermost orbiting wrap 152 by a preset interval, and the second oil supply outlet portion 1562*d* forming the outlet of the second compression chamber oil supply hole 1562 may be formed at a position spaced apart from the inner circumferential surface of the outermost orbiting wrap 152 by a preset interval.

For example, when the position of the first oil supply outlet portion 1561*d* is defined as a first oil supply position P1, the position of the second oil supply outlet portion 1562*d* is defined as a second oil supply position P2, a radial distance from the outer circumferential surface of the outermost orbiting wrap 152 to the first oil supply position P1 is defined as a first outlet distance L1, and a radial distance from the inner circumferential surface of the outermost orbiting wrap 152 to the second oil supply position P2 is defined as a second outlet distance L2, the positions of the first oil supply outlet portion 1561*d* and the second oil supply outlet portion 1562*d* may be calculated (determined or set), respectively.

That is, the position of the first oil supply outlet portion 1561*d* and the position of the second oil supply outlet portion 1562*d* according to the implementation may be determined such that the first outlet distance L1 is greater than or equal to a value obtained by subtracting the inner diameter d1 of the first oil supply outlet portion 1561*d* from the wrap thickness t of the orbiting wrap 152 and the second outlet distance L2 is greater than or equal to a value obtained by subtracting the inner diameter d2 of the second oil supply outlet portion 1562*d* from the wrap thickness t of the orbiting wrap 152. This may be expressed by the following relation:

{Wrap thickness−Oil supply outlet portion≤Position of Oil supply outlet portion}

In other words, the first oil supply outlet portion 1561*d* according to the implementation may be formed at a position spaced apart from the outer circumferential surface of the outermost orbiting wrap 152 by the inner diameter d1 of the first oil supply outlet portion 1561*d* or farther, and the second oil supply outlet portion 1562*d* according to the implementation may be formed at a position spaced apart from the inner circumferential surface of the outermost orbiting wrap 152 by the inner diameter d2 of the second oil supply outlet portion 1562*d* or farther.

Here, the first outlet distance L1 may be greater than or equal to the second outlet distance L2. This will be described in detail later with reference to FIG. 15.

Accordingly, when the orbiting scroll 150 performs the orbiting motion relative to the fixed scroll 140, the first compression chamber oil supply hole 1561 (precisely, the first oil supply outlet portion) may almost communicate only with the first compression chamber V1 and the second compression chamber oil supply hole 1562 (precisely, the second oil supply outlet portion) may almost communicate only with the second compression chamber V2.

Figure 15:
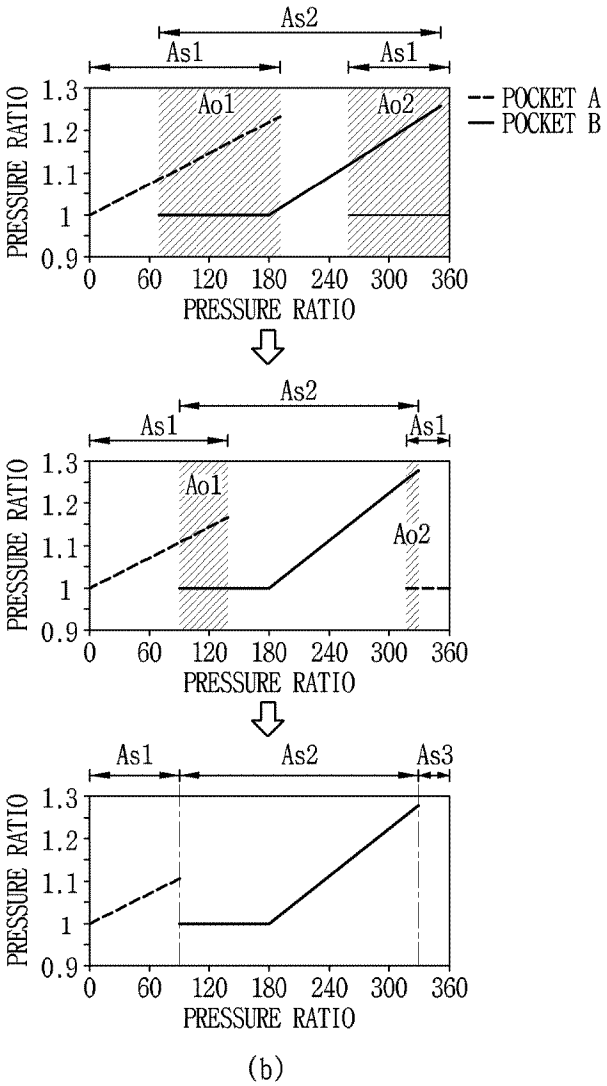
FIG. 15 is a schematic view illustrating open sections of the respective compression chamber oil supply holes according to positions of the first compression chamber oil supply hole and the second compression chamber oil supply hole in accordance with an implementation of the present disclosure.
Figure 15:
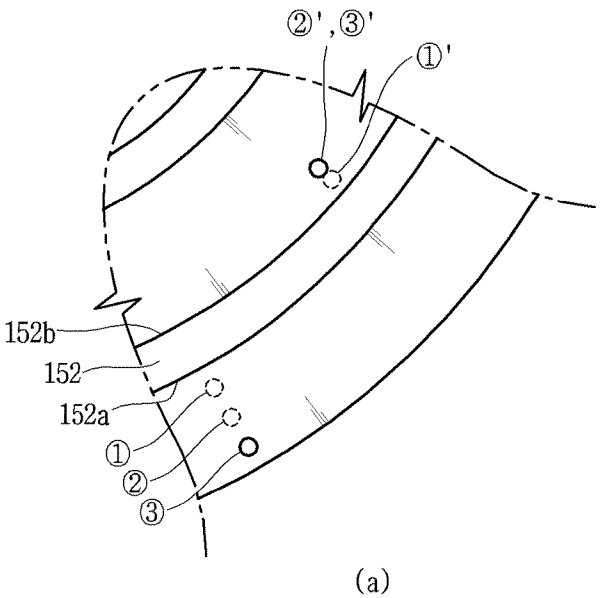

FIG. 15 is a schematic view illustrating open sections of the respective compression chamber oil supply holes according to positions of the first compression chamber oil supply hole and the second compression chamber oil supply hole in accordance with an implementation of the present disclosure. (a) of FIG. 15 illustrates implementations in which the position of the first oil supply outlet portion is divided into three stages and the position of the second oil supply outlet portion is divided into two stages. (b) of FIG. 15 shows graphs that analyze an oil supply section of each compression chamber based on a crank angle in the case of the division shown in (a) of FIG. 15.

As illustrated in (a) and (b) of FIG. 15, when the first oil supply outlet portion 1561*d* is formed at a position ① adjacent to an outer circumferential surface 152*a* of the orbiting wrap 152 and the second oil supply outlet portion 1562*d* is formed at a position ①' adjacent to an inner circumferential surface 152*b* of the orbiting wrap 152, a first oil supply section in which the first oil supply outlet portion 1561*d* communicates with the first compression chamber V1 corresponds to a section in a crank angle range of approximately −100° to 190° and a second oil supply section in which the second oil supply outlet portion 1562*d* communicates with the second compression chamber V2 corresponds to a section in a crank angle range of approximately 70° to 350°. [See a top graph in (b) of FIG. 15]

Accordingly, a section in which the first oil supply section As1 and the second oil supply section As2 overlap each other, that is, a section in which the first compression chamber V1 and the second compression chamber V2 communicate with each other corresponds to approximately 70° to 190° (first overlap section) Ao1 and to approximately 250° to 350° (second overlap section) Ao2. These first overlap section Ao1 and second overlap section Ao2 are slashed in (b) of FIG. 15.

In these overlap sections Ao1 and Ao2, the first compression chamber V1 and the second compression chamber V2 may communicate with each other through the first compression chamber oil supply hole 1561 and the second compression chamber oil supply hole 1562. Then, a back flow of refrigerant from the first compression chamber V1 to the second compression chamber V2 may occur in the first overlap section Ao1 and a back flow of refrigerant from the second compression chamber V2 to the first compression chamber V1 may occur in the second overlap section Ao2, due to a pressure difference between the first and second compression chambers V1 and V2.

Referring back to (a) and (b) of FIG. 15, when the first oil supply outlet portion 1561*d* is formed at a position ② farther spaced apart from the outer circumferential surface 152*a* of the orbiting wrap 152 and the second oil supply outlet portion 1562*d* is formed at a position ②' farther spaced apart from the inner circumferential surface 152*b* of the orbiting wrap 152, the first oil supply section As1 in which the first oil supply outlet portion 1561*d* communicates with the first compression chamber V1 corresponds to a section in a crank angle range of approximately −40° to 140° and the second oil supply section As2 in which the second oil supply outlet portion 1562*d* communicates with the second compression chamber V2 corresponds to a section in a crank angle range of 90° to 330°. [See a middle graph of (b) of FIG. 15]

Accordingly, a section in which the first oil supply section As1 of the first compression chamber V1 and the second oil supply section V2 of the second compression chamber V2 overlap each other, that is, a section in which the first compression chamber V1 and the second compression chamber V2 communicate with each other corresponds to approximately 90° to 140° (overlap section) Ao1 and to approximately 320° to 330° (overlap section) Ao1. These overlap sections Ao1 and Ao2 are slashed in (b) of FIG. 15.

In these overlap sections Ao1 and Ao2, as aforementioned, the first compression chamber V1 and the second compression chamber V2 may communicate with each other through the first compression chamber oil supply hole 1561 and the second compression chamber oil supply hole 1562. Then, a back flow of refrigerant from the first compression chamber V1 to the second compression chamber V2 may occur in the overlap sections Ao1 and Ao2 due to a pressure difference between the first and second compression chambers V1 and V2.

However, in this case, as described above, the overlap sections Ao1 and Ao2 may be shortened, compared to those formed when the first oil supply outlet portion 1561*d* and the second oil supply outlet portion 1562*d* are disposed adjacent to the side surface of the orbiting wrap 152, thereby reducing leakage between the compression chambers by that much.

Referring back to (a) and (b) of FIG. 15, when the first oil supply outlet portion 1561*d* is formed at a position ③ farthest spaced apart from the outer circumferential surface 152*a* of the orbiting wrap 152 and the second oil supply outlet portion 1562*d* is formed at a position ③' farther spaced apart from the inner circumferential surface 152*b* of the orbiting wrap 152, the first oil supply section As1 in which the first oil supply outlet portion 1561*d* communicates with the first compression chamber V1 corresponds to a section in a crank angle range of approximately 0° to 90° and the second oil supply section As2 in which the second oil supply outlet portion 1562*d* communicates with the second compression chamber V2 corresponds to a section in a crank angle range of 90° to 330°.

Here, the position of ③' is the same as that the position ② '. Therefore, the distance (the first outlet distance L1) from the outer circumferential surface of the orbiting wrap 152 to the first oil supply outlet portion 1561 may be longer than the distance (the second outlet distance L2) from the inner circumferential surface of the orbiting wrap 152 to the second oil supply outlet portion 1562. [See a bottom graph of (b) of FIG. 15]

Accordingly, a section in which the first oil supply section As1 of the first compression chamber V1 and the second oil supply section As2 of the second compression chamber V2 overlap each other, that is, an overlap section in which the first compression chamber V1 and the second compression chamber V2 communicate with each other may hardly occur.

This may allow oil to be smoothly supplied to the first compression chamber V1 and the second compression chamber V2, so as to reduce friction loss in the compression unit and prevent leakage between the compression chambers through the first compression chamber oil supply hole 1561 and the second compression chamber oil supply hole 1562. This may result in enhancing compression efficiency.

In addition, a non-oil supply section As3 may be formed between the start of the first oil supply section As1 and the end of the second oil supply section As2 based on the crank angle. That is, as illustrated in (b) of FIG. 15, the non-oil supply section As3, in which oil is not supplied because the first oil supply outlet portion 1561*d* and the second oil supply outlet portion 1562*d* are blocked, may be formed between the start of the first oil supply section As1 and the end of the second oil supply section As2. This non-oil supply section As3 may be formed to be greater than 0° and smaller than or equal to 30°. In this way, the non-oil supply section in which oil is not supplied to the compression chambers V1 and V2 can be minimized so as to reduce friction loss as much as possible.

On the other hand, the foregoing implementation illustrates the oil supply structure in the scroll compressor having the suction passage opening and closing valve disposed in the suction passage. However, in some cases, the oil supply structure may also be equally applied to a scroll compressor in which the suction passage opening and closing valve is not disposed in the suction passage.

Figure 16:
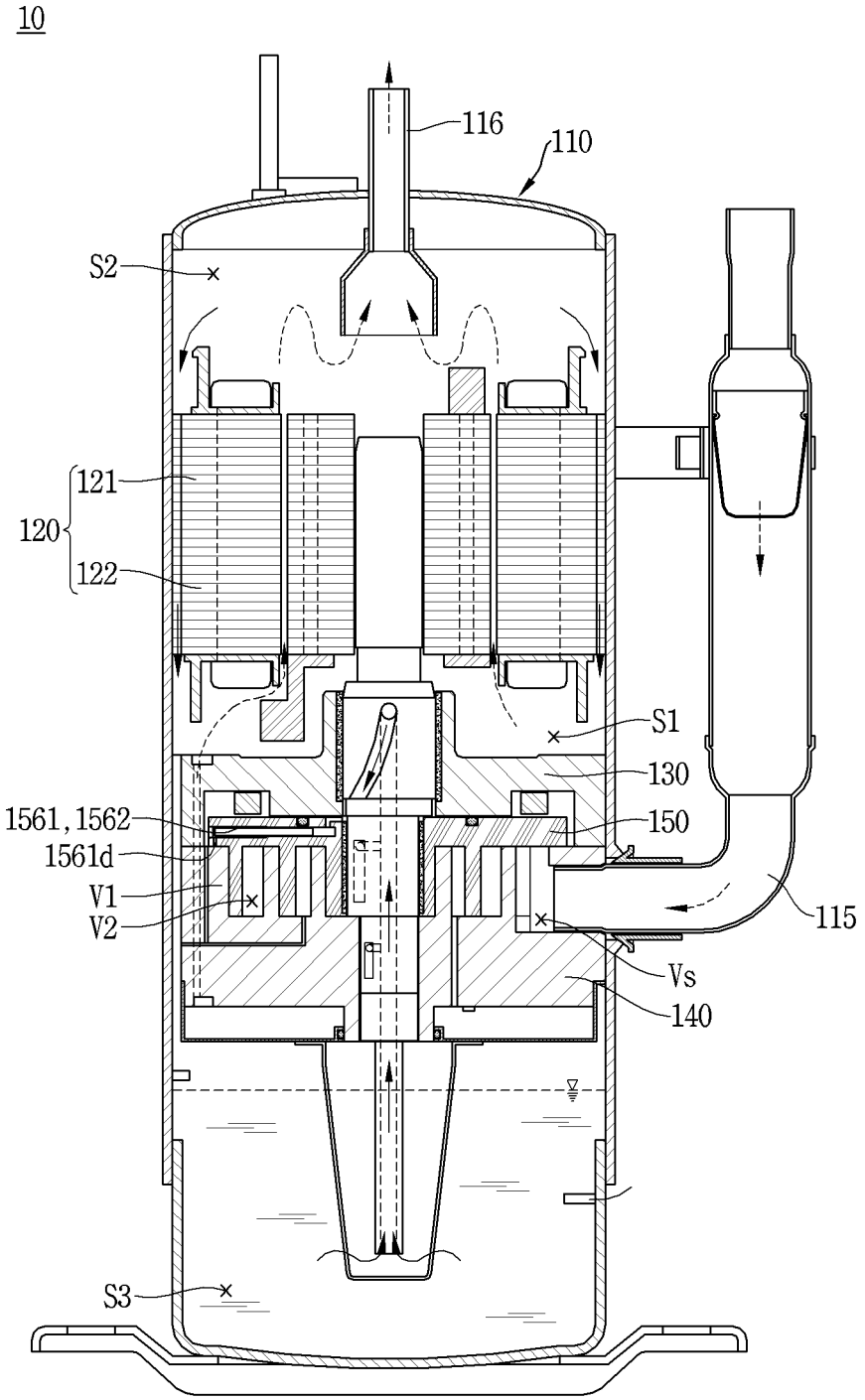
FIG. 16 is a longitudinal sectional view illustrating another implementation of a scroll compressor, to which the compression chamber oil supply holes according to the present disclosure are applied.

FIG. 16 is a longitudinal sectional view illustrating another implementation of a scroll compressor, to which the compression chamber oil supply holes according to the present disclosure are applied.

Referring to FIG. 16, a basic structure of a scroll compressor according to this implementation is the same as that of the foregoing implementation illustrated in FIG. 2, and thus a description thereof will be replaced with the description of the foregoing implementation.

For example, in the scroll compressor according to this implementation, the first compression chamber oil supply hole 1561 and the second compression chamber oil supply hole 1562 may be provided to communicate with the first compression chamber V1 and the second compression chamber V2, respectively.

The first compression chamber oil supply hole 1561 and the second compression chamber oil supply hole 1562 may be formed in the same manner as in the foregoing implementation. Specifically, the oil supply section of the first oil supply outlet portion 1561*d* forming the outlet of the first compression chamber oil supply hole 1561 and the second oil supply outlet portion 1562*d* forming the outlet of the second compression chamber oil supply hole 1562 may not overlap each other. The positions of the first oil supply outlet portion 1561*d* and the second oil supply outlet portion 1562*d* are the same as those of the foregoing implementation.

Accordingly, the first compression chamber V1 and the second compression chamber V2 can be prevented from communicating with each other through the first compression chamber oil supply hole 1561 and the second compression chamber oil supply hole 1562, thereby suppressing refrigerant from leaking between the compression chambers in advance.

However, in this implementation, the refrigerant suction pipe 115 may be inserted through the casing 110 and communicate with the suction chamber Vs through the fixed scroll 140 in the radial direction. In this case, a separate suction passage opening and closing valve may not be installed between the refrigerant suction pipe and the suction chamber, and in some cases, may alternatively be installed.

Meanwhile, although not shown in the drawings, the first compression chamber oil supply hole and the second compression chamber oil supply hole may be equally applied to a so-called top-compression type scroll compressor in which a compression unit is located above a motor unit. A description of this will be replaced by the description of the foregoing implementations.

What is claimed is:

1. A scroll compressor comprising:

a casing;

a driving motor provided in the casing;

a fixed scroll disposed at a side of the driving motor, the fixed scroll including a fixed end plate and a fixed wrap positioned at the fixed end plate;

an orbiting scroll including (i) an orbiting end plate facing the fixed end plate, and (ii) an orbiting wrap positioned at the orbiting end plate and configured to be engaged with the fixed wrap to define a first compression chamber and a second compression chamber;

a first compression chamber oil supply hole that is defined at the orbiting end plate and configured to be in fluid communication with the first compression chamber; and a second compression chamber oil supply hole that is defined at the orbiting end plate and configured to be in fluid communication with the second compression chamber, wherein the first compression chamber oil supply hole is configured to be opened toward the first compression chamber during a first oil supply stage, wherein the second compression chamber oil supply hole is configured to be opened toward the second compression chamber during a second oil supply stage, wherein the first oil supply stage does not overlap the second oil supply stage, wherein the first compression chamber oil supply hole includes a first outlet that is in fluid communication with the first compression chamber, wherein the second compression chamber oil supply hole includes a second outlet that is in fluid communication with the second compression chamber, wherein the first outlet and the second outlet are located at portions of the orbiting end plate such that the first oil supply stage and the second oil supply stage do not overlap each other, and wherein the first outlet of the first compression chamber oil supply hole is defined at a first position that permits the first compression chamber oil supply hole to fluidly communicate with the first compression chamber based on a suction in the first compression chamber being completed.

2. The scroll compressor of claim 1, wherein the first compression chamber is defined between an inner circumferential surface of the fixed wrap and an outer circumferential surface of the orbiting wrap, wherein the second compression chamber is defined between an outer circumferential surface of the fixed wrap and an inner circumferential surface of the orbiting wrap, wherein the first compression chamber oil supply hole includes a first outlet that is spaced apart by a first distance from an outer circumferential surface of an outermost orbiting wrap, and wherein the second compression chamber oil supply hole includes a second outlet that is spaced apart by a second distance from an inner circumferential surface of the outermost orbiting wrap.

3. The scroll compressor of claim 2, wherein the first distance is greater than or equal to the second distance.

4. The scroll compressor of claim 2, wherein the first distance is greater than or equal to a first value obtained by subtracting an inner diameter of the first outlet of the first compression chamber oil supply hole from a first wrap thickness of the orbiting wrap adjacent to the first outlet of the first compression chamber oil supply hole.

5. The scroll compressor of claim 4, wherein the second distance is greater than or equal to a second value obtained by subtracting an inner diameter of the second outlet of the second compression chamber oil supply hole from a second wrap thickness of the orbiting wrap adjacent to the second outlet of the second compression chamber oil supply hole.

6. The scroll compressor of claim 2, wherein the first outlet of the first compression chamber oil supply hole is spaced apart by a first distance from the outer circumferential surface of the outermost orbiting wrap, the first distance being equal to or greater than an inner diameter of the first outlet of the first compression chamber oil supply hole, and wherein the second outlet of the second compression chamber oil supply hole is spaced apart by a second distance from the inner circumferential surface of the outermost orbiting wrap, the second distance being equal to or greater than an inner diameter of the second outlet of the second compression chamber oil supply hole.

7. The scroll compressor of claim 1, wherein the second oil supply stage starts at an end of the first oil supply stage, and the first oil supply stage starts at a preset interval from an end of the second oil supply stage.

8. The scroll compressor of claim 7, wherein the preset interval corresponds to a crank angle of greater than 0° and smaller than or equal to 30°.

9. The scroll compressor of claim 1, wherein the second outlet of the second compression chamber oil supply hole is defined at a second position that permits the second compression chamber oil supply hole to fluidly communicate with the second compression chamber based on a suction in the second compression chamber being completed.

10. The scroll compressor of claim 9, wherein the first outlet of the first compression chamber oil supply hole is configured, based on a crank angle being 0° at a position that an outer circumferential surface of a suction end of the orbiting wrap contacts an inner circumferential surface of the fixed wrap, to be defined in a first range that permits first pockets to overlap each other, the first pockets defining the first compression chamber respectively at crank angles of 0°, 90°, and 180°.

11. The scroll compressor of claim 10, wherein the second outlet of the second compression chamber oil supply hole is configured, based on the crank angle being 0° at the position that the outer circumferential surface of the suction end of the orbiting wrap contacts the inner circumferential surface of the fixed wrap, to be defined in a second range that permits second pockets to overlap each other, the second pockets defining the second compression chamber respectively at crank angles of 180°, 260°, and 320°.

12. The scroll compressor of claim 1, wherein the second compression chamber oil supply hole includes a second outlet configured to be blocked with respect to the second compression chamber in the first oil supply stage, and wherein the first compression chamber oil supply hole includes a first outlet configured to be blocked with respect to the first compression chamber in the second oil supply stage.

13. The scroll compressor of claim 12, wherein the first outlet of the first compression chamber oil supply hole is configured to be defined in a crank angle range of 0° to 90° in a first pressure ratio stage, and wherein the second outlet of the second compression chamber oil supply hole is configured to be defined in a crank angle range of 180° to 260° in the first pressure ratio stage.

14. The scroll compressor of claim 13, wherein the first outlet of the first compression chamber oil supply hole is configured to be defined in a crank angle range of 90° to 180° in a second pressure ratio stage, and wherein the second outlet of the second compression chamber oil supply hole is configured to be defined in a crank angle range of 260° to 320° in the second pressure ratio stage, the second pressure ratio stage being greater than the first pressure ratio stage.

15. The scroll compressor of claim 14, wherein the first outlet of the first compression chamber oil supply hole is configured to be defined in a crank angle range of 180° to 250° in a third pressure ratio stage, and wherein the second outlet of the second compression chamber oil supply hole is configured to be defined in a crank angle range of 320° to 380° in the third pressure ratio stage, the third pressure ratio stage being greater than the second pressure ratio stage.

16. The scroll compressor of claim 1, wherein the orbiting scroll includes an oil accommodating portion that is in fluid communication with an inner space of the casing, and wherein the first compression chamber oil supply hole and the second compression chamber oil supply hole are in fluid communication with the oil accommodating portion.

17. The scroll compressor of claim 16, wherein the orbiting scroll defines a rotating shaft coupling portion through the orbiting scroll in an axial direction, the rotating shaft coupling portion configured to receive a rotating shaft, the scroll compressor further comprising an eccentric portion bearing that is fitted with an inner circumferential surface of the rotating shaft coupling portion, and wherein the eccentric portion bearing is shorter in length than the rotating shaft coupling portion, and wherein the oil accommodating portion is defined at an annular shape between an end of the eccentric portion bearing and the inner circumferential surface of the rotating shaft coupling portion.

18. The scroll compressor of claim 15, further comprising:

a first pressure reducer positioned in the first compression chamber oil supply hole, and a second pressure reducer positioned in the second compression chamber oil supply hole, wherein an outer diameter of the first pressure reducer is smaller than an inner diameter of the first compression chamber oil supply hole, and wherein an outer diameter of the second pressure reducer is smaller than an inner diameter of the second compression chamber oil supply hole.

19. A scroll compressor comprising:

a casing;

a driving motor provided in the casing;

a fixed scroll disposed at a side of the driving motor, the fixed scroll including a fixed end plate and a fixed wrap positioned at the fixed end plate;

an orbiting scroll including (i) an orbiting end plate facing the fixed end plate, and (ii) an orbiting wrap positioned at the orbiting end plate and configured to be engaged with the fixed wrap to define a first compression chamber and a second compression chamber;

a first compression chamber oil supply hole that is defined at the orbiting end plate and configured to be in fluid communication with the first compression chamber; and a second compression chamber oil supply hole that is defined at the orbiting end plate and configured to be in fluid communication with the second compression chamber, wherein the first compression chamber oil supply hole is configured to be opened toward the first compression chamber during a first oil supply stage, wherein the second compression chamber oil supply hole is configured to be opened toward the second compression chamber during a second oil supply stage, and wherein the first oil supply stage overlaps the second oil supply stage during a first period of time, and does not overlap the second oil supply stage during a second period of time, the second period of time being longer than the first period of time.

* * * * *